US005883324A

United States Patent [19]

Saito

[11] Patent Number: 5,883,324

[45] Date of Patent: Mar. 16, 1999

[54] SIGNAL GENERATING APPARATUS AND SIGNAL GENERATING METHOD

[75] Inventor: Tsutomu Saito, Shizuoka-ken, Japan

[73] Assignee: Kabushiki Kaisha Kawai Gakki Seisakusho, Hamamatsu, Japan

[21] Appl. No.: 572,714

[22] Filed: Dec. 14, 1995

[30] Foreign Application Priority Data

Dec. 14, 1994 [JP] Japan ..... 6-333092

[51] Int. Cl.[6] ..... G10H 7/00; G10H 7/02

[52] U.S. Cl. ..... 84/603

[58] Field of Search ..... 84/603

[56] References Cited

U.S. PATENT DOCUMENTS 4,611,522 9/1986 Hideo ..... 84/1.01
4,901,615 2/1990 Matsushima et al. ..... 84/605
4,916,996 4/1990 Suzuki et al. ..... 84/603
5,639,978 6/1997 Saito ..... 84/603

*Primary Examiner*—Jack A. Lane

[57] ABSTRACT

A signal generating apparatus and a signal generating method, for storing specific sampling data $D_M$, wherein $0<M<N-1$, selected among sampling data $D_i$ obtained by sampling a wave in sampling points $P_i$, wherein i=0, 1, 2, . . . N−1, and differential wave data $\Delta WD_n$, wherein n=1, 2, 3, . . . , M−1, M+1, . . . N−2, N−1, obtained by "$\Delta WD_n=D_n-D_{n-1}$", consecutively generating wave readout address $A_M$ for designating the specific sampling data $D_M$ and wave readout address $A_n$ for designating the differential wave data $\Delta WD_n$, storing the specific sampling data $D_M$ designated by the wave readout address $A_M$ in temporary storage, when the generated wave readout address is $A_M$, or accumulating the differential wave data $\Delta WD_n$ designated by the wave readout address $A_n$ in the temporary storage, thereby to generate sampling data $YD_n$, when the generated wave readout address is $A_n$, and generating a signal on the basis of the obtained specific sampling data $D_M$ or sampling data $YD_n$.

16 Claims, 21 Drawing Sheets

Fig. 2 (ii)
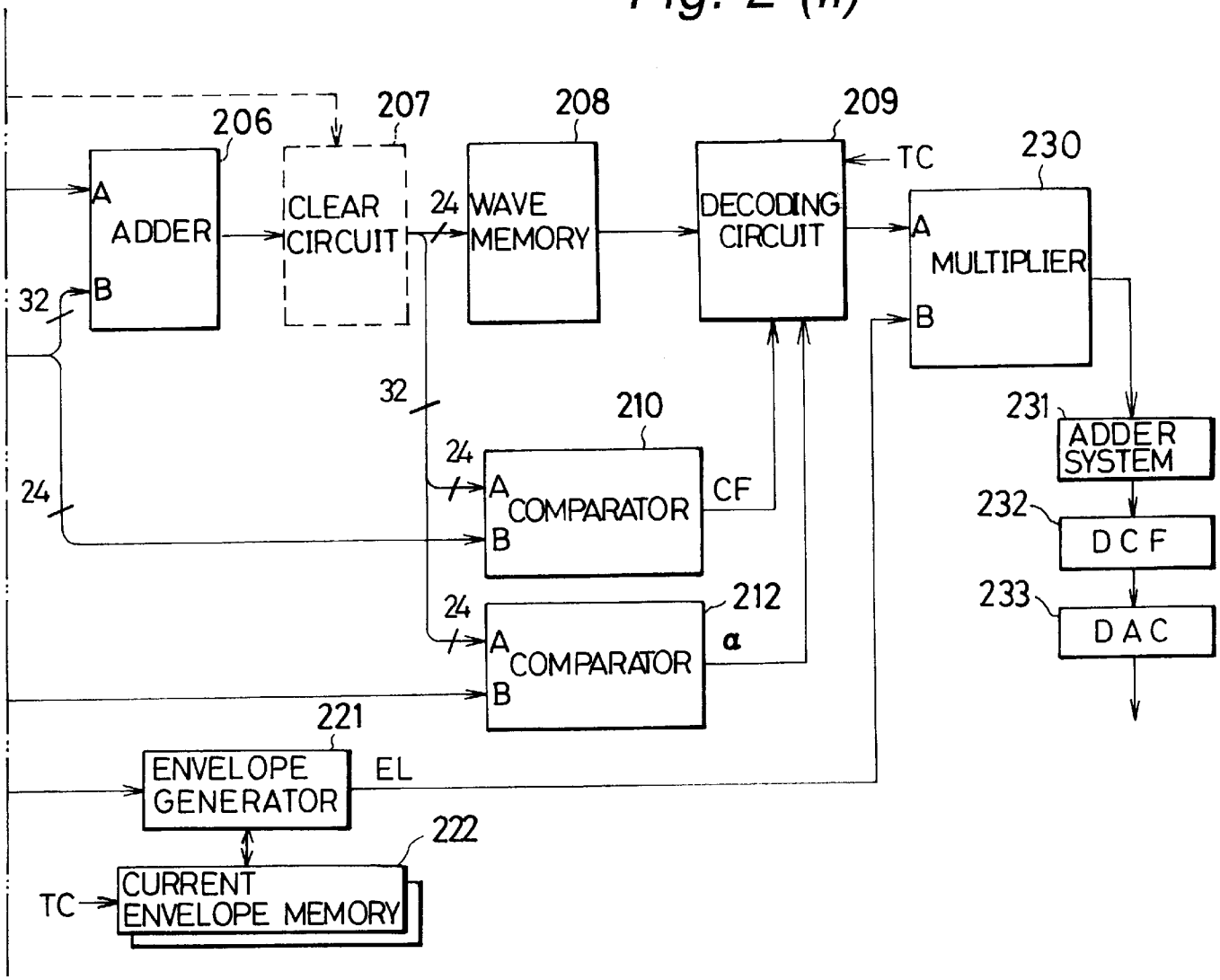

FDPCM DATA FORMAT

TRANSLATION FROM FDPCM DATA TO DPCM DATA

Fig. 7 (ii)
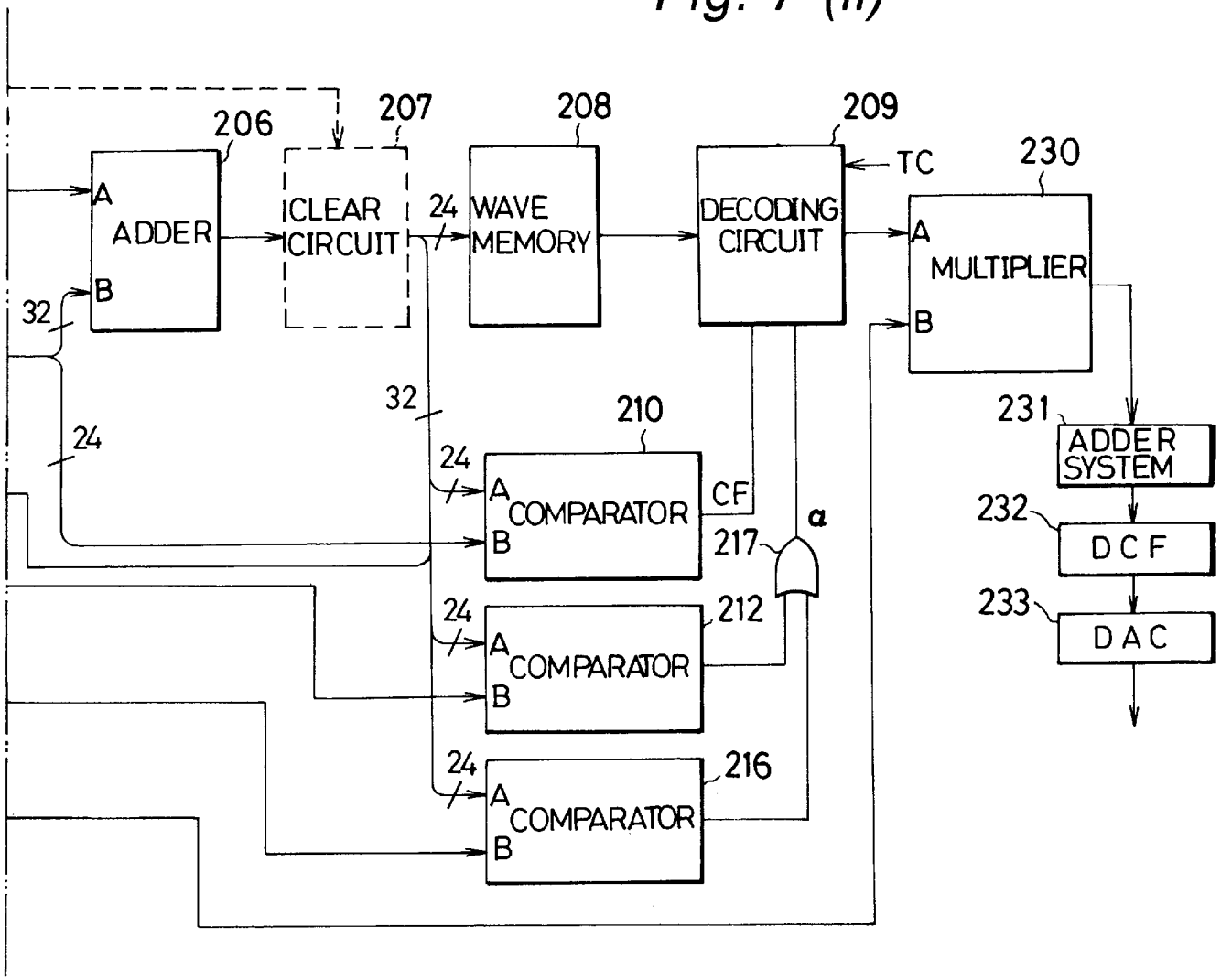

Fig. 8 (ii)
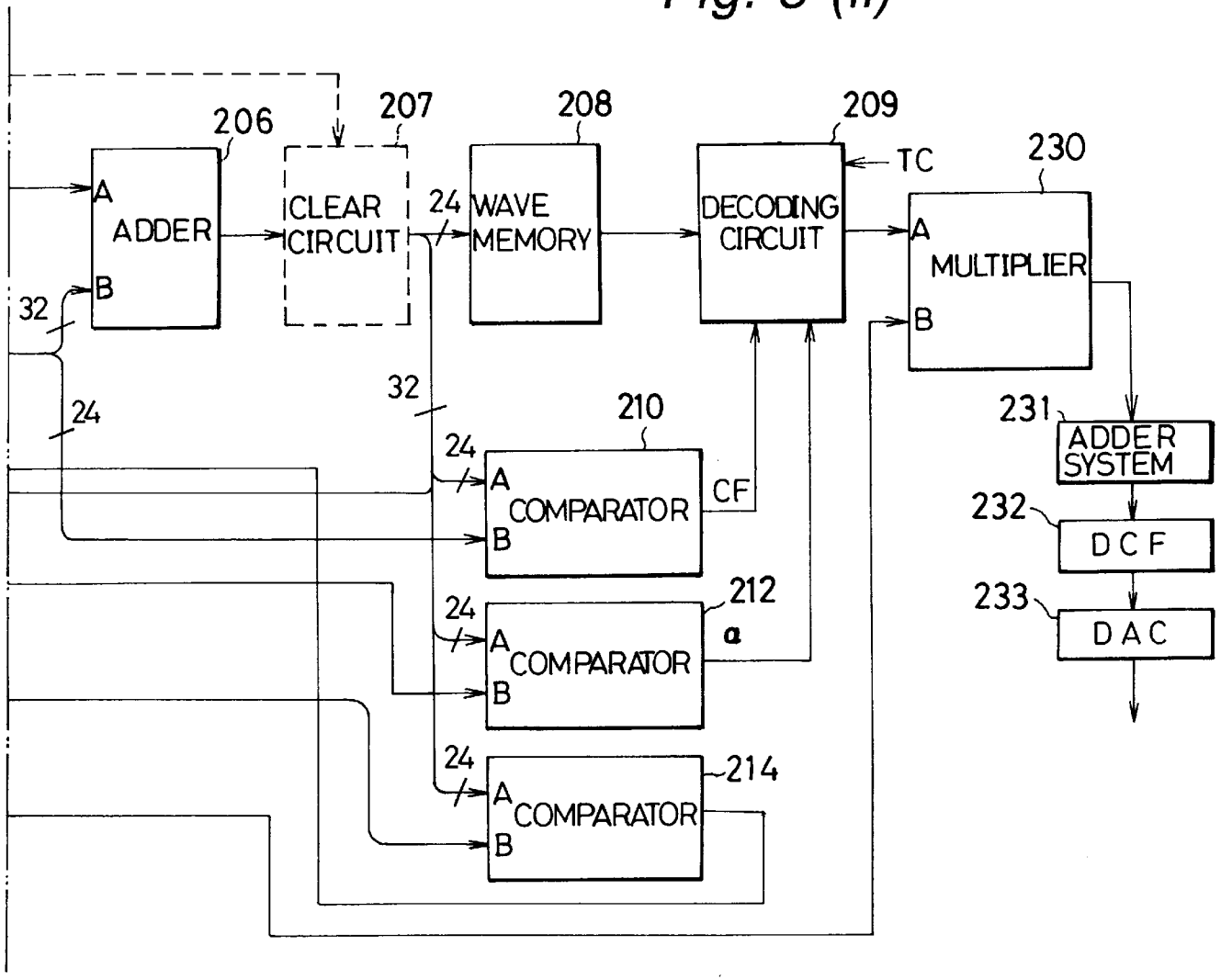

CONTROL FLAG LATCH
202
TC
CLRA
CURRENT STEP MEMORY
203
TC
32
2'S COMPLEMENT CIRCUIT
240
β
CURRENT ADDRESS MEMORY
205
SELECTOR
204
2
1
0
S1
S0
7
250
LOOP TOP ADDRESS MEMORY
211
24
LOOP END ADDRESS MEMORY
213
24
ENVELOPE PARAMETER MEMORY
220
ENVELOPE GENERATOR
221
EL
CURRENT ENVELOPE MEMORY
222
TC
UD FLAG
245
β
TC
32
LATCH
200
CT
16
DB
TIMING GENERATOR
201
SEL
TC
CLK
24
AB
CNT

Fig. 9 (ii)
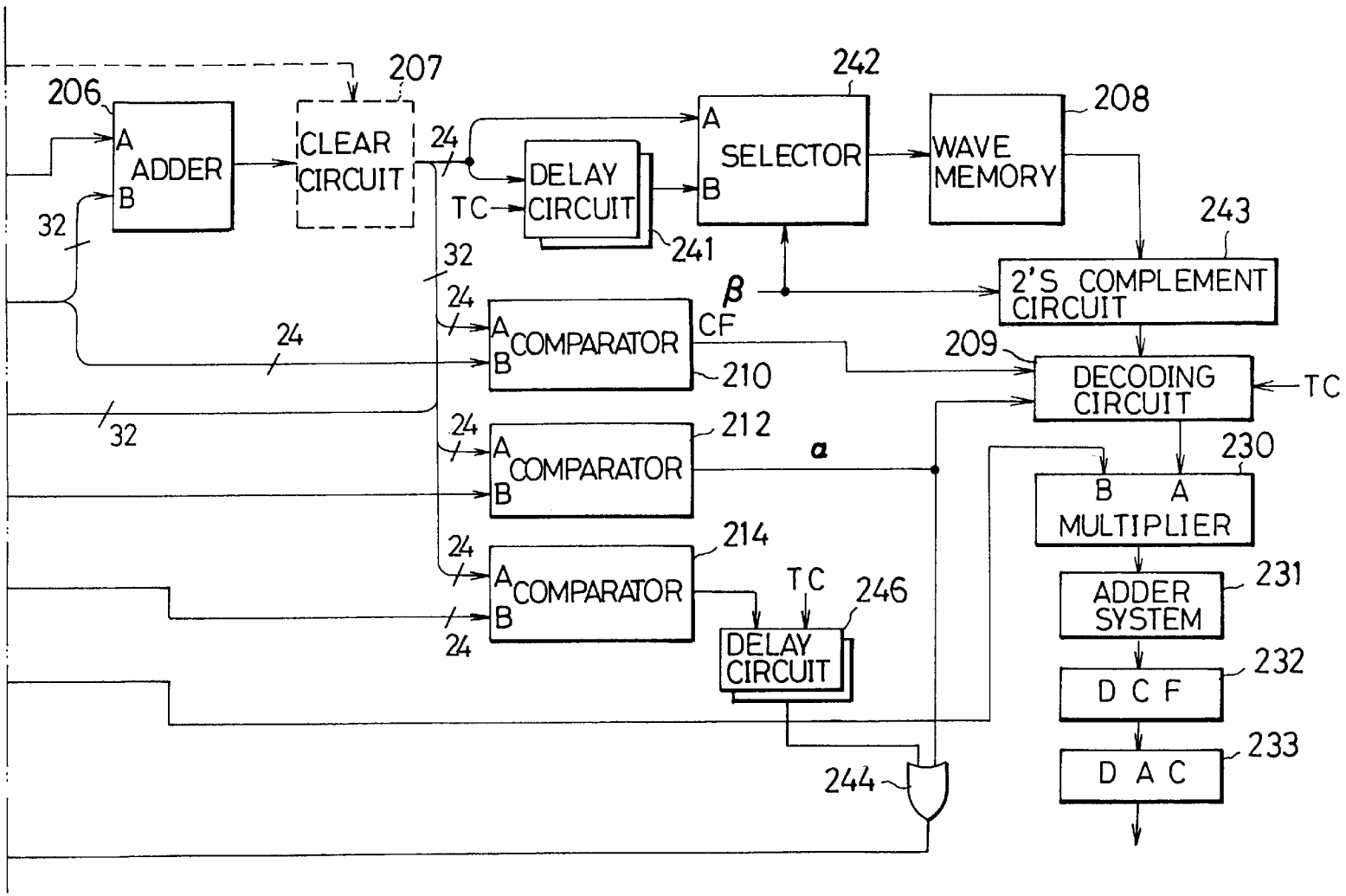

Fig. 10 (ii)
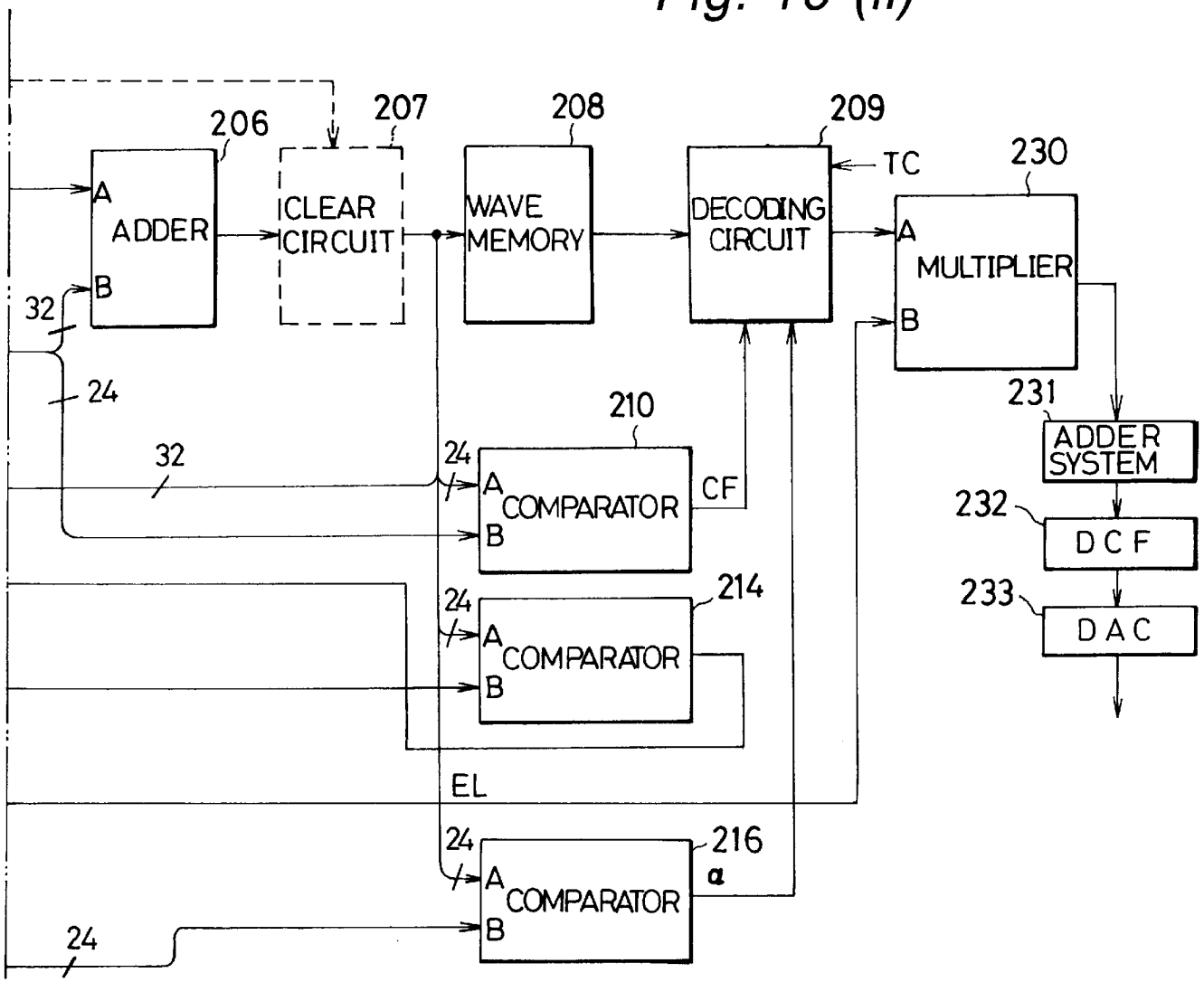

Fig. 13 (ii)
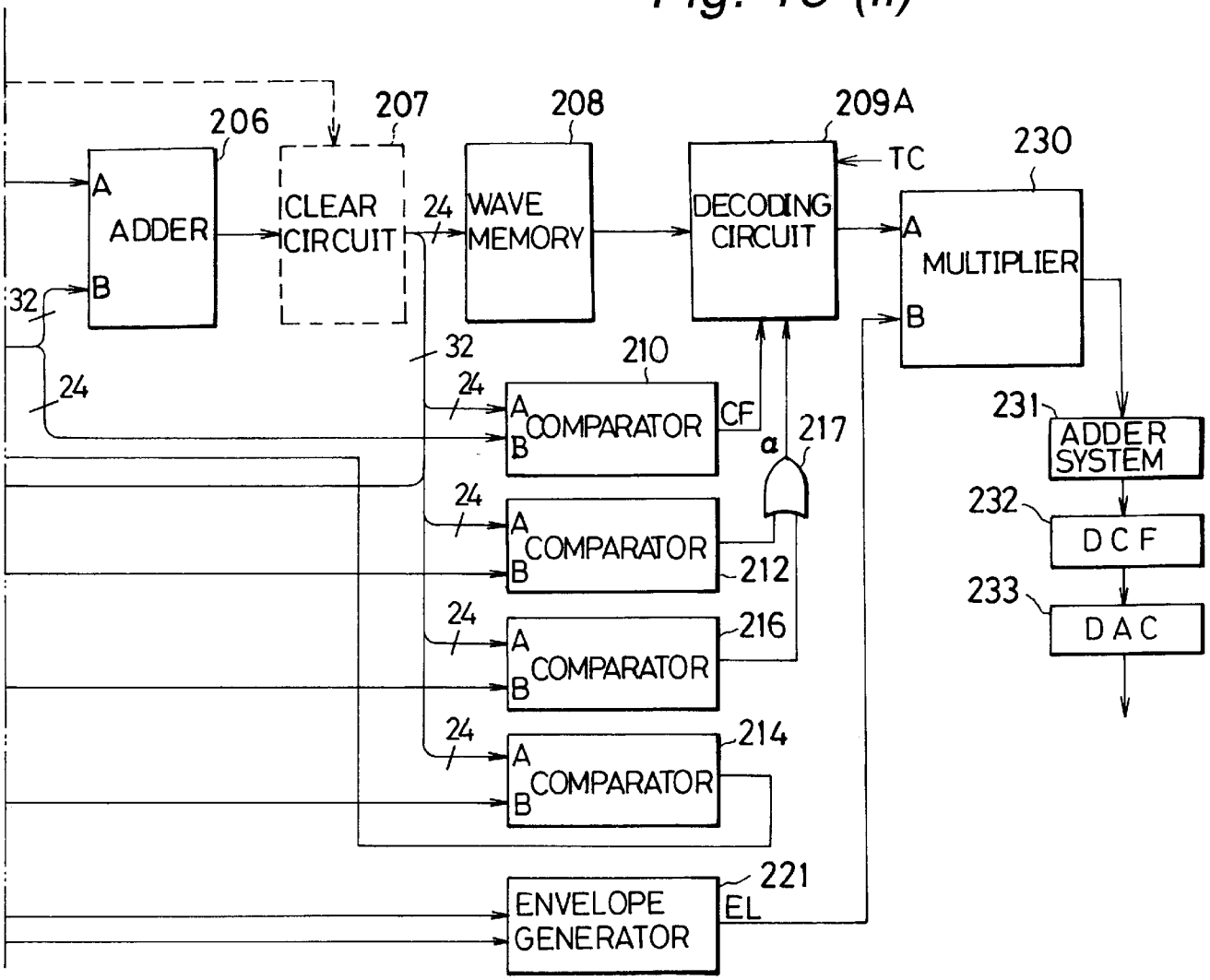

CLRA
CONTROL FLAG LATCH
202
TC
CURRENT STEP MEMORY
203
32
CURRENT ADDRESS MEMORY
205
TC
SELECTOR
204
2
1
0
S1
S0
250
LOOP TOP ADDRESS MEMORY
211
24
FIRST INITIALIZING ADDRESS MEMORY
215A
24
SECOND INITIALIZING ADDRESS MEMORY
215 B
24
LOOP END ADDRESS MEMORY
213
24
CURRENT ENVELOPE MEMORY
222
TC
ENVELOPE PARAMETER MEMORY
220
TC
LATCH
200
32
CT
16
DB
TIMING GENERATOR
201
SEL
TC
CLK
24
AB
CNT

Fig. 14 (ii)
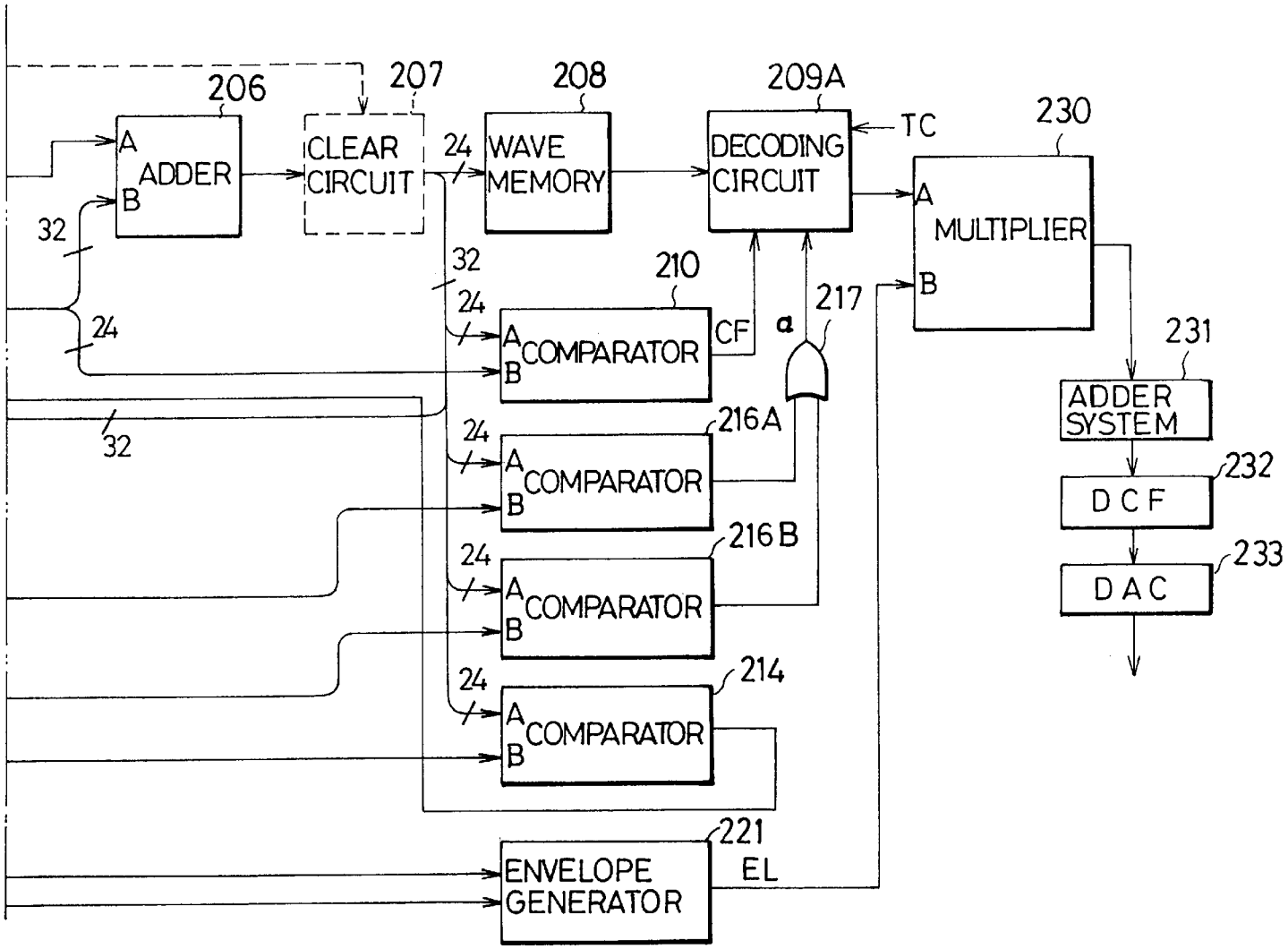

SIGNAL GENERATING APPARATUS AND SIGNAL GENERATING METHOD

BACKGROUND OF THE INVENTION AND RELATED ART

The present invention relates to a signal generating apparatus for generating a signal on the basis of specific sampling data and differential wave data stored in wave storage means, and a signal generating method therefor.

Conventional electronic instruments have musical tone signal generating apparatus. This musical tone signal generating apparatus generates a musical tone signal on the basis of wave data stored in a wave memory. For example, wave data of PCM format are stored in the wave memory. The wave data of PCM format are prepared by sampling a musical tone wave at a predetermined frequency, quantizing the sampling data and further coding the quantized data. The wave data of PCM format are consecutively read out from the wave memory according to tone-generating instructions, and a musical tone signal is generated on the basis of the wave data which have been read out.

In the musical tone signal generating apparatus, for generating musical tone signals corresponding to a great number of timbres, it is required to store a vast amount of wave data of PCM format in the wave memory. For decreasing the amount of the wave data, there is therefore employed, for example, a coding technique such as a DPCM (Differential Pulse Code Modulation) method and an ADPCM (Adaptive Differential Pulse Code Modulation) method. In these methods, for example, wave data of PCM format is converted to differential wave data and stored in the wave memory. And, when a musical tone is generated, the differential wave data from the wave memory is accumulated, and reproduced into the original wave data of PCM format.

For decreasing the amount of wave data to be stored in the wave memory, the following method is also generally employed. For example, as shown in FIG. 6, only wave data in a predetermined section (attack section) of the head of a musical tone wave and wave data in a predetermined section (repeat section) of the musical tone wave subsequent thereto are stored in the wave memory. When a musical tone signal is generated, the wave data of the attack section are read out from its top once, and thereafter, the wave data of the repeat section are repeatedly read out. The musical tone signal generating apparatus generates musical tone signals on the basis of these wave data which have been read out.

However, the above DPCM method and ADPCM method have been scarcely employed for musical tone signal generating apparatus of electronic musical instruments. That is because errors caused by preparing differential wave data of DPCM or ADPCM format are accumulated when the differential wave data of the repeat section are repeatedly accumulated.

Although having the above problem, the ADPCM method or the DPCM method is vigorously studied since the amount of the wave data can be decreased. For example, U.S. Pat. No. 4,916,996, corresponding to JP-A-62-242995, discloses "musical tone generating apparatus with reduced data storage requirements" for overcoming the above problem.

In the above musical tone generating apparatus, the wave memory (ADPCM data memory 2) stores differential wave data alone. When the differential wave data are read out for the first time, the wave data (PCM code) obtained by accumulating the final differential wave data of the attack section is latched. In the above musical tone generating apparatus, when the differential wave data at the top of the repeat section is read out subsequently to the final differential wave data of the repeat section, the differential wave data at the top of the repeat section is accumulated on the previously latched wave data, thereby to reproduce PCM code.

One variant of the musical tone generating apparatus disclosed in U.S. Pat. No. 4,916,996 is provided with a memory in place of the above latch. This memory stores wave data (PCM code) equivalent to the wave data (PCM code) to be obtained by accumulating the final differential wave data of the attack section. When the differential wave data at the top of the repeat section is read out subsequently to the final differential wave data of the repeat section, the differential wave data at the top of the repeat section is accumulated on the wave data (PCM code) stored in the memory, thereby to reproduce wave data (PCM code).

In the musical tone generating apparatus and the variant thereof disclosed in U.S. Pat. No. 4,916,996, the errors accumulated within the attack section cannot be removed. Further, when the differential wave data of the attack section and those of the repeat section are read only once, the accumulated errors cannot be removed. Further, the above musical tone generating apparatus has a defect in that its circuit is complicated since the apparatus is required to have latches 206, 218 for storing the wave data (d(n), E(n)+eγ(n)) obtained by accumulating the final differential wave data of the attack section. The above variant has a defect in that its circuit is complicated since the apparatus is required to have memories 206A, 218A for storing wave data (PCM code) equivalent to the wave data to be obtained by accumulating the final differential wave data of the attack section.

OBJECT AND SUMMARY OF THE INVENTION

It is an object of the present invention to provide a signal generating apparatus which has a simple circuit constitution and can suppress error accumulation caused by repeatedly reading out differential wave data of the repeat section when a wave is reproduced on the basis of the differential wave data, and which further can suppress error accumulation when the differential wave data is read out only once, and a signal generating method therefor.

The above object and advantages of the present invention are achieved by a signal generating apparatus according to the first aspect of the present invention, which comprises (A) wave storage means for storing specific sampling data $D_M$ (wherein $0<M<N-1$) selected among sampling data $D_i$ obtained by sampling a wave at sampling points $P_i$ (wherein i=0, 1, 2, . . . N−1) and differential wave data $\Delta WD_n$ (wherein n=1,2,3, . . . , M−1, M+1, . . . N−2, N−1) obtained by Equation (1), $$\Delta WD_n = D_n - D_{n-1} \qquad \text{Equation (1)}$$

(B) address generating means for consecutively generating wave readout address $A_M$ for designating the specific sampling data $D_M$ in the wave storage means and wave readout address $A_n$ for designating the differential wave data $\Delta WD_n$ in the wave storage means, (C) temporary storage means, (D) decoding means for receiving the specific sampling data $D_M$ designated by the wave readout address $A_M$ from the wave storage means and storing the specific sampling data $D_M$ in the temporary storage means when the address generating means generates the wave readout address $A_M$, and for receiving the differential wave data $\Delta WD_n$ designated by the wave readout address $A_n$ from the wave storage means and accumulating the differential wave data $\Delta WD_n$ in the temporary storage means and thereby generating sampling data $YD_n$ when the address generating means generates the wave readout address $A_n$, and (E) signal generating means for generating a signal on the basis of the obtained specific sampling data $D_M$ or sampling data $YD_n$.

The specific sampling data $D_M$ and the differential wave data $\Delta WD_n$ to be stored in the wave storage means are prepared as follows for example. First, for example as shown in FIG. 6, a predetermined head section of a wave (attack section) and a predetermined section subsequent thereto (repeat section) are extracted. Then, these extracted attack section and repeat section are sampled at a predetermined frequency, to obtain a plurality of sampling data $D_i$ (i=0, 1, 2, . . . N−1). The sampling data $D_i$ may have, for example, PCM format. The specific sampling data $D_M$ (0<M<N−1) is selected among the sampling data $D_i$ in an quantity of N. The number of the specific sampling data may be, for example, one. The content of the specific sampling data $D_M$ may be determined as required. On the other hand, the differential wave data $\Delta WD_n$ is obtained by deducting sampling data $D_{n-1}$ from the sampling data $D_n$, provided that n=1,2,3, . . . ,M−1,M+1, . . . N−2,N−1. The differential wave data $\Delta WD_n$ may have, for example, DPCM format or ADPCM format.

In the signal generating apparatus according to the first aspect of the present invention, when the wave readout address $A_n$ is generated by the address generating means, the decoding means receives the differential wave data $\Delta WD_n$ from the wave storage means. The differential wave data $\Delta WD_n$ is accumulated in the temporary storage means, whereby the sampling data $YD_n$ is generated. The obtained sampling data $YD_n$ is used for generating a signal. This accumulation is repeated, whereby the sampling data $YD_n$ (n=1, 2, . . . ) is consecutively updated, and signals are generated with the passage of time.

On the other hand, when the wave readout address $A_M$ is generated by the address generating means, the decoding means receives the specific sampling data $D_M$ from the wave storage means. The specific sampling data $D_M$ is used for generating a signal. Further, the specific sampling data $D_M$ is stored in the temporary storage means as initial sampling data for accumulating the differential wave data $\Delta WD_n$ (n=M+1, M+2, . . . ).

According to the signal generating apparatus according to the first aspect of the present invention, the decoding means initializes the temporary storage means with the specific sampling data $D_M$ when the wave readout address $A_M$ is generated, whereby error accumulation caused by accumulating the differential wave data $\Delta WD_n$ can be suppressed. Such error occurs when the differential wave data $\Delta WD_n$ is prepared. Meanwhile, in the musical tone generating apparatus disclosed in U.S. Pat. No. 4,916,996, temporary storage means D-FF205, 215 is not initialized when the differential wave data of the repeat section is read out only once.

Further, the number of the specific sampling data may be two or more. A plurality of specific sampling data $D_{M1}$ (0<M1<N−1), $D_{M2}$(0<M2<N−1), . . . are selected among N pieces of the sampling data $D_i$. The content of each of the specific sampling data $D_{M1}$, $D_{M2}$, . . . may be determined as required, and the contents may be of the same value or of different values. The differential wave data $\Delta WD_n$ is prepared to satisfy n=1, 2, 3, . . . N−2, N−1 wherein n≠M1, M2 . . . .

In the above case, the address generating means consecutively generates the wave readout address $A_n$ for designating the differential wave data $\Delta WD_n$ and the wave readout addresses $A_{M1}$, $A_{M2}$, . . . for designating the specific sampling data $D_{M1}$, $D_{M2}$, . . . in the wave storage means. The decoding means receives the specific sampling data $D_{M1}$, $D_{M2}$, . . . from the wave storage means. The specific sampling data $D_{M1}$, $D_{M2}$, . . . are used for generating signals and are also stored in the temporary storage means as initial sampling data for accumulating the differential wave data $\Delta WD_n$.

According to the above signal generating apparatus, the decoding means uses a plurality of the specific sampling data $D_{M1}$, $D_{M2}$, . . . to initialize the temporary storage means, so that a small error accumulation can be also suppressed.

In a preferred embodiment of the signal generating apparatus according to the first aspect of the present invention, the address generating means can be constituted so as to generate the wave readout address $A_0$, $A_1$, . . . , $A_{M-1}$, $A_M$, $A_{M+1}$, . . . , $A_{N-1}$, and then, to generate the wave readout address $A_M$ and the wave readout address $A_n$ (wherein n=M+1, . . . N−1) in an ascending order. Therefore, the specific sampling data $D_M$ and the differential wave data $\Delta WD_{M+1}$, $\Delta WD_{M+2}$, . . . $\Delta WD_{N-1}$ are repeatedly read out from the wave storage means in an ascending order. In this preferred embodiment, the wave readout address $A_{N-1}$ is generated, and then, the wave readout address $A_M$ is generated, so that the decoding means initializes the temporary storage means with the specific sampling data $D_M$. As a result, error accumulation caused by repeated readout of the differential wave data can be suppressed.

In other preferred embodiment of the signal generating apparatus according to the first aspect of the present invention, the address generating means can be constituted so as to generate the wave readout address $A_0$, $A_1$, . . . , $A_{M-1}$, $A_M$, $A_{M+1}$, . . . , $A_{N-1}$, and then, to generate the wave readout address $A_{ud}$ (wherein ud=N−2, N−3, N−4, . . . M+1) in a descending order. The decoding means can be constituted so as to receive the differential wave data $\Delta D_{ud+1}$ designated by the wave readout address $A_{ud+1}$ from the wave storage means, and to degressively deduct the differential wave data $\Delta WD_{ud+1}$ in the temporary storage means, thereby to generate sampling data $YD_{ud}$. The address generating means can be further constituted so as consecutively generate the wave readout address $A_M$ and the wave readout address $A_n$, wherein n=M+1, M+2, . . . N−1, in an ascending order, after the address generating means generates the wave readout address $A_{M+1}$. Therefore, the specific sampling data $D_M$ and the differential wave data $\Delta WD_{M+1}$, $\Delta WD_{M+2}$, . . . $\Delta WD_{N-1}$ are read out from the wave storage means in an ascending order, and the differential wave data $\Delta WD_{N-2}$, $\Delta WD_{N-3}$, . . . $\Delta WD_{M+1}$ are read out from the wave storage means in a descending order. And, these readout in an ascending order and readout in a descending order are repeatedly performed.

In other preferred embodiment of the signal generating apparatus according to the first aspect of the present invention, the address generating means can be constituted so as to generate the wave readout address $A_0$, $A_1$, . . . , $A_{M-1}$, $A_M$, $A_{M+1}$, . . . , $A_{N-1}$, and then, the wave readout address $A_n$ (wherein n=R, R+1, . . . M−1, M+1, . . . N−1 and R is determined so as to satisfy that the sampling data $D_{R-1}$ equals the sampling data $D_{N-1}$) and the wave readout address $A_M$ in an ascending order. The decoding means initializes the temporary storage means with the specific sampling data $D_M$ each time when the wave readout address $A_M$ is generated.

The reason why "R" is determined so as to satisfy that the sampling data $D_{R-1}$ equals the sampling data $D_{N-1}$ is as follows. That is, the sampling data $YD_R$ is obtained by "$D_{R-1}+\Delta WD_R$" or "$YD_{N-1}+\Delta WD_R$". Therefore, the sampling data $YD_{R-1}$ and the sampling data $YD_{N-1}$ should be the same. The relationships between the sampling data $D_{R-1}$ and the sampling data $YD_{R-1}$ and between the sampling data $D_{N-1}$ and the sampling data $YD_{N-1}$ should satisfy the followings.

$$D_{R-1}=YD_{R-1}+e_{R-1}$$

$$D_{N-1}=YD_{N-1}+e_{N-1}$$

wherein $e_{R-1}$ and $e_{N-1}$ are the amount of error accumulation. Suppose that $e_{R-1}=e_{N-1}$, for obtaining the relationship of $$D_{R-1}+\Delta WD_R=YD_{N-1}+\Delta WD_R,$$

the relationship of sampling data $D_{R-1}$=the sampling data $D_{N-1}$ should be satisfied. As a result, in the wave readout address $A_R$, the sampling data $YD_R$ having the same value is always generated, and the signal necessarily has the same form. Therefore, the function of repeatedly generating the signal having the same form is achieved.

The above object and advantages of the present invention are achieved by a signal generating apparatus according to the second aspect of the present invention, which comprises (A) wave storage means for storing specific sampling data $D_M$ (wherein 0<M<n−1) selected among sampling data $D_i$ obtained by sampling a wave at sampling points $P_i$ (wherein i=0, 1, 2, . . . N−1) and differential wave data $\Delta Wd_n$ (wherein n=1, 2, 3, . . . , M−1, M+1, . . . N−2, N−1) obtained by Equation (2)

$$\Delta Wd_n = D_n - \sum_{k=1}^{q} \gamma_k D_{n-k} \qquad \text{Equation (2)}$$

wherein $\gamma_k$ is a linear predictive coefficient and q is a degree, (B) address generating means for consecutively generating wave readout address $A_M$ for designating the specific sampling data $D_M$ in the wave storage means and wave readout address $A_n$ for designating the differential wave data $\Delta Wd_n$ in the wave storage means, (C) temporary storage means having memory areas $S_k$ in a quantity of q (wherein k=1, 2, . . . q), (D) decoding means for receiving the specific sampling data $D_M$ designated by the wave readout address $A_M$ from the wave storage means, then moving a content of the memory area $S_k$ (wherein k=1, 2, . . . q−1) of the temporary storage means to the memory area $S_{k+1}$, and then, storing the specific sampling data $D_M$ in the memory area $S_1$ when the address generating means generates the wave readout address $A_M$, and for receiving the differential wave data $\Delta Wd_n$ designated by the wave readout address $A_n$ from the wave storage means to generate sampling data $Yd_n$ by Equation (3), then moving a content of the memory area $S_k$ (k=1, 2, . . . q−1) of the temporary storage means to the memory area $S_{k+1}$, and then, storing the sampling data $Yd_n$ in the memory area $S_1$ when the address generating means generates the wave readout address $A_n$, $$Yd_n = \Delta Wd_n + \sum_{k=1}^{q} \gamma_k YS_{n-k} \qquad \text{Equation (3)}$$

wherein $YS_{n-k}$ is a content of the memory area $S_k$ (k=1, 2, . . . q) of the temporary storage means, and (E) signal generating means for generating a signal on the basis of the obtained specific sampling data $D_M$ or sampling data $Yd_n$.

The specific sampling data $D_M$ (0<M<N−1) to be stored in the wave storage means is selected among the sampling data $D_i$ like a case of the signal generating apparatus according to the first aspect of the present invention. The number of the specific sampling data $D_M$ is one or more. On the other hand, the differential wave data $\Delta Wd_n$ (n=1, 2, 3, . . . , M−1, M+1, . . . N−2, N−1) is obtained by deducting sampling data predicted by a linear prediction method from the sampling data $D_n$. The differential wave data $\Delta Wd_n$ may have, for example, DPCM format, ADPCM format or the like.

In the signal generating apparatus according to the second aspect of the present invention, when the address generating means generates the wave readout address $A_n$, the decoding means receives the differential wave data $\Delta Wd_n$ from the wave storage means. Past sampling data $YS_{n-k}$ in a quantity of q are stored in the memory area $S_k$ (k=1, 2, . . . q) of the temporary storage means. The decoding means predicts sampling data on the basis of q pieces of the sampling data $YS_{n-k}$ by a linear prediction method. Then, the decoding means adds the differential wave data $\Delta Wd_n$ to the predicted sampling data, thereby to the generate the sampling data $Yd_n$. The obtained sampling data $Yd_n$ is stored in the memory area $S_1$ for predicting subsequent sampling data.

On the other hand, when the address generating means generates the wave readout address $A_M$, the decoding means receives the specific sampling data $D_M$ from the wave storage means. The specific sampling data $D_M$ is stored in the memory area $S_1$ as initialized sampling data for predicting subsequent sampling data.

In a preferred embodiment of the signal generating apparatus according to the second aspect of the present invention, the specific sampling data consists of specific sampling data $D_m$ (wherein m=M, M+1, . . . M+q−1 and q is a degree) in a quantity of q. In this preferred embodiment, the temporary storage means stores q pieces of sampling data $YS_M(=D_M)$, $YS_{M+1}(=D_{M+1})$, . . . $YS_{M+q-1}(=D_{M+q-1})$ at a certain stage. Therefore, the decoding means can predict sampling data on the basis of the content of the temporary storage means and generate the sampling data $Yd_{M+q}$.

In the above preferred embodiment, the address generating means can be constituted so as to generate the wave readout address $A_0, A_1, \ldots, A_{M-1}, A_M, A_{M+1}, \ldots, A_{N-1}$, and then, to generate the wave readout address $A_m$ (wherein m=M, M+1, . . . M+q−1) and the wave readout address $A_n$ (wherein n=M+q, M+q+1, . . . N−1) in an ascending order. In this preferred embodiment, the decoding means initializes the temporary storage means with the specific sampling data $D_m$ each time when the wave readout address $A_m$ is generated, whereby error accumulation caused by the repeated readout of the differential wave data can be suppressed.

Further, in the above preferred embodiment, the address generating means can be constituted so as to generate the wave readout address $A_0, A_1, \ldots, A_{M-1}, A_M, A_{M+1}, \ldots, A_{N-1}$, and then, to generate wave readout address $A_n$ (wherein n=R, R+1, . . . M−1, M+q, M+q+1, . . . N−1 and R is determined to satisfy that the sampling data $D_{R-k}$ equals the sampling data $D_{N-k}$ wherein k=1, 2, . . . q) and the wave readout address $A_m$ (wherein m=M, M+1, . . . M+q−1) in an ascending order. In this preferred embodiment, the decoding means initializes the temporary storage means with specific sampling data $D_m$ each time when the wave readout address $A_m$ is generated.

The reason why "R" is determined to satisfy that the sampling data $D_{R-k}$ equals the sampling data $D_{N-k}$ is as follows. That is, the sampling data $Yd_R$ is obtained by "$\Delta Wd_R+\gamma_1 Yd_{R-1}+\gamma_2 Yd_{R-2}+. . .$" or "$\Delta Wd_R+\gamma_1 Yd_{N-1}+$ $\gamma_2 Yd_{N-2}+\ldots$" on the basis of Equation (3). Therefore, the sampling data $Yd_{R-k}$ and the sampling data $Yd_{N-k}$ should be the same. The relationships between the sampling data $D_{R-k}$ and the sampling data $Yd_{R-k}$ and between the sampling data $D_{N-k}$ and the sampling data $Yd_{N-k}$ should satisfy the followings.

$$D_{R-k}=Yd_{R-k}+e_{R-k}$$

$$D_{N-k}=YD_{N-k}+e_{N-k}$$

wherein $e_{R-k}$ and $e_{N-k}$ are the amount of error accumulation. Suppose that $e_{R-k}=e_{N-k}$, for obtaining the relationship of $$\Delta Wd_R+\gamma_1 Yd_{R-1}+\gamma_2 Yd_{R-2}+\ldots \equiv \Delta Wd_R+\gamma_1 Yd_{N-1}+\gamma_2 Yd_{N-2}+\ldots$$

the relationship of sampling data $D_{R-k}$=the sampling data $D_{N-k}$ should be satisfied. As a result, in the wave readout address $A_R$, the sampling data $Yd_R$ having the same value is always generated, and the signal necessarily has the same form. Therefore, the function of repeatedly generating the signal having the same form is achieved.

A signal generating method according to first aspect of the present invention is a method of generating a signal on the basis of specific sampling data $D_M$ (wherein 0<M<N−1) selected among sampling data $D_i$ obtained by sampling a wave in sampling points $P_i$ (wherein i=0, 1, 2, . . . N−1) and differential wave data $\Delta WD_n$ (wherein n=1, 2, 3, . . . , M−1, M+1, . . . N−2, N−1) obtained by Equation (4), $$\Delta WD_n=D_n-D_{n-1} \qquad \text{Equation (4)}$$

the method comprising;

(A) consecutively generating wave readout address $A_M$ for designating the specific sampling data $D_M$ and wave readout address $A_n$ for designating the differential wave data $\Delta WD_n$, (B) storing the specific sampling data $D_M$ designated by the wave readout address $A_M$ in memory area, when the generated wave readout address is $A_M$, or accumulating the differential wave data $\Delta WD_n$ designated by the wave readout address $A_n$ in the memory area, thereby to generate sampling data $YD_n$, when the generated wave readout address is $A_n$, and (C) generating a signal on the basis of the obtained specific sampling data $D_M$ or sampling data $YD_n$.

In a preferred embodiment of the signal generating method according to the first aspect of the present invention, the wave readout address $A_0, A_1, \ldots, A_{M-1}, A_M, A_{M+1}, \ldots, A_{N-1}$ are generated, and then, the wave readout address $A_M$ and $A_n$ (wherein n=M+1, . . . N−1) are generated in an ascending order.

In another preferred embodiment of the signal generating method according to the first aspect of the present invention, the wave readout address $A_0, A_1, \ldots, A_{M-1}, A_M, A_{M+1}, \ldots, A_{N-1}$ are generated, then, the wave readout address $A_{ud}$ (wherein ud=N−2, N−3, N−4, . . . M+1) are consecutively generated in a descending order, and differential wave data $\Delta WD_{ud+1}$ designated by the wave readout address $A_{ud+1}$ is degressively deducted in the memory area, thereby to generate the sampling data $YD_{ud}$. After the wave readout address $A_{M+1}$ is generated, the wave readout address $A_M$ and wave readout address $A_n$ (wherein n=M+1, M+1, . . . N−1) are consecutively generated in an ascending order.

In further another preferred embodiment of the signal generating method according to the first aspect of the present invention, the wave readout address $A_0, A_1, \ldots, A_{M-1}, A_M, A_{M+1}, \ldots, A_{N-1}$ are generated, and then, the wave readout address $A_n$ (wherein n=R, R+1, . . . M−1, M+1, . . . N−1 and R is determined so as to satisfy that the sampling data $D_{R-1}$ equals the sampling data $D_{N-1}$) and the wave readout address $A_M$ in an ascending order.

A signal generating method according to a second aspect of the present invention is a method of generating a signal on the basis of specific sampling data $D_M$ (wherein 0<M<N−1) selected among sampling data $D_i$ obtained by sampling a wave in sampling points $P_i$ (wherein i=0, 1, 2, . . . N−1) and differential wave data $\Delta Wd_n$ (wherein n=1, 2, 3, . . . , M−1, M+1, . . . N−2, N−1) obtained by Equation (5), $$\Delta Wd_n = D_n - \sum_{k=1}^{q} \gamma_k D_{n-k} \qquad \text{Equation (5)}$$

wherein $\gamma_k$ is a linear predictive coefficient and q is a degree, the method comprising;

(A) consecutively generating wave readout address $A_M$ for designating the specific sampling data $D_M$ and wave readout address $A_n$ for designating the differential wave data $\Delta WD_n$, (B) moving a content of memory area $S_k$ (k=1, 2, . . . q−1) to the memory area $S_{k+1}$, and then, storing the specific sampling data $D_M$ designated by the wave readout address $A_M$ in the memory area $S_1$, when the generated wave readout address is $A_M$, or generating sampling data $Yd_n$ by Equation (6), then moving a content of the memory area $S_k$ (k=1, 2, . . . q−1) to the memory area $S_{k+1}$ and storing the sampling data $Yd_n$ in the memory area $S_1$, $$Yd_n = \Delta Wd_n + \sum_{k=1}^{q} \gamma_k YS_{n-k} \qquad \text{Equation (6)}$$

wherein $\Delta Wd_n$ is the differential wave data designated by the wave readout address $A_n$ and $YS_{n-}k$ is a content of the memory area $S_k$ (k=1, 2, . . . q), and (C) generating a signal on the basis of the obtained specific sampling data $D_M$ or sampling data $Yd_n$.

In a preferred embodiment of the signal generating method according to the second aspect of the present invention, the specific sampling data consists of specific sampling data $D_m$ (wherein m=M, M+1, . . . M+q−1 and q is a degree) in a quantity of q.

The constitution of the above preferred embodiment may be as follows. The wave readout address $A_0, A_1, \ldots, A_{M-1}, A_M, A_{M+1}, \ldots, A_{N-1}$ are generated, and then, the wave readout address $A_m$ (wherein m=M, M+1, . . . M+q−1) and the wave readout address $A_n$ (wherein n=M+q, M+q+1, . . . N−1) are consecutively generated in an ascending order.

The constitution of the above preferred embodiment may be as follows. The wave readout address $A_0, A_1, \ldots, A_{M-1}, A_M, A_{M+1}, \ldots, A_{N-1}$ are generated, and then, the wave readout address $A_n$ (wherein n=R, R+1, . . . M−1, M+q, M+q+1, . . . N−1 and R is determined so as to satisfy that the sampling data $D_{R-k}$ equals the sampling data $D_{N-k}$ wherein k=1, 2, . . . q) and the wave readout address $A_m$ (wherein m=M, M+1, . . . M+q−1) are consecutively generated in an ascending order.

DESCRIPTION OF THE PREFERRED EMBODIMENTS

The application of the signal generating apparatus and the signal generating method of the present invention to a musical tone signal generating apparatus and a musical tone signal generating method will be explained hereinafter. In addition, the present invention shall not be limited to a musical tone signal generating apparatus and a musical tone signal generating method, and it can be applied, for example, to an apparatus and a method for generating an artificial voice signal and other various signal generating apparatus and methods. The musical tone signal generating apparatus is constituted of a tone generation circuit, a CPU for controlling the tone generation circuit and the like, while the constitution and operation of the CPU are well known, and the following explanation is mainly focused on the constitution and operation of the tone generation circuit.

The musical tone signal generating apparatus has a plurality of tone generating channels, and each tone generating channel generates its own musical tone signal. A plurality of the tone generating channels operate on the time-sharing basis. Therefore, the musical tone signal generating apparatus can simultaneously generate a plurality of musical tone signals. For simplifying the explanation, however, the constitution and operation of one tone generating channel of the musical tone signal generating apparatus will be explained below unless otherwise particularly specified.

EXAMPLE 1

Example 1 is concerned with the signal generating apparatus and the signal generating method according to the first aspect of the present invention. A signal is generated on the basis of a plurality of differential wave data $\Delta WD_n$ of DPCM format and one specific sampling data $D_M$ of PCM format. The differential wave data $\Delta WD_n$ and the specific sampling data $D_M$ are read out from the wave storage means once in an ascending order.

Figure 4:
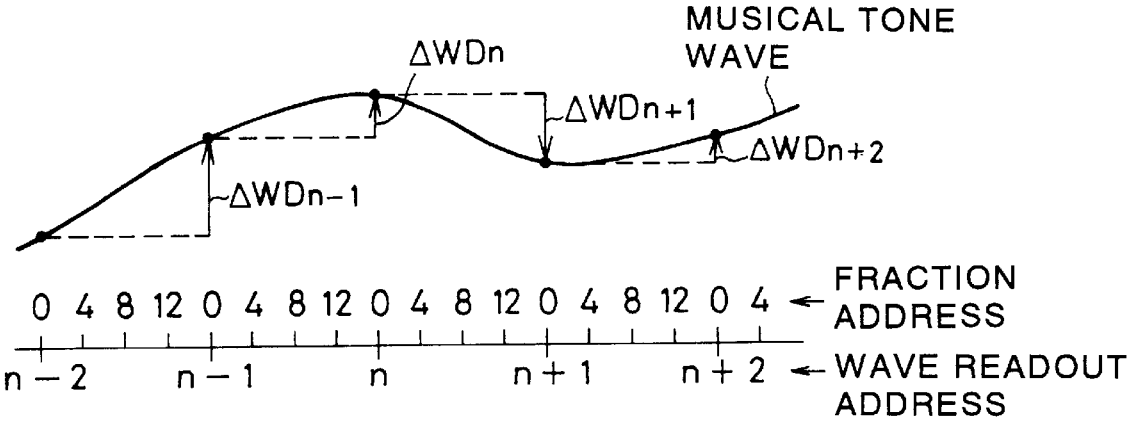
FIG. 4 is a view for the explanation of a method for preparing wave data used in Examples 1 to 5.

The differential wave data $\Delta WD_n$ is prepared as follows. As shown in FIG. 4, a wave is sampled in sampling points $P_i$ (i=0, 1, 2, . . . N−1) at a predetermined frequency, the sampled data are quantized, and the quantized data are coded to obtain sampling data $D_i$ (i=0, 1, 2, . . . N−1). The sampling data $D_i$ are of PCM format, and are expressed in 2's complement format. The differential wave data $\Delta WD_n$ is obtained by deducting the sampling data $D_{n-1}$ from the sampling data $D_n$ provided that n=1, 2, 3, . . . , M−1, M+1, . . . N−2, N−1. The differential wave data $\Delta WD_n$ are of DPCM format and expressed in 2's complement format. Therefore, the differential wave data can be expressed by any one of positive numbers and negative numbers. For example, in FIG. 4, the differential wave data $\Delta WD_n$ ($=D_n-D_{n-1}$) showing a difference between the sampling data $D_n$ in sampling point $P_n$ and the sampling data $D_{n-1}$ in sampling point $P_{n-1}$ is obtained as a positive number. Similarly, the differential wave data $\Delta WD_{n+1}$ ($=D_{n+1}-D_n$) showing a difference between the sampling data $D_{n+1}$ in sampling point $P_{n+1}$ and the sampling data $D_n$ in sampling point $P_n$ is obtained as a negative number.

The so-obtained differential wave data $\Delta WD_n$ of DPCM format are stored in a wave memory 208 to be described later. The wave memory 208 corresponds to the wave storage means of the present invention.

In the process of preparing the differential wave data $\Delta WD_n$, when specific sampling data $D_M$ (0<M<N−1) is selected among the sampling data $D_i$ (i=0, 1, 2, . . . N−1) of PCM format, no differential wave data $\Delta WD_M$ is prepared. The selected specific sampling data $D_M$ is directly stored in the wave memory 208. In a position designated by wave readout address $A_0$ in the wave memory 208, the sampling data $D_0$ is stored.

Figure 3A:
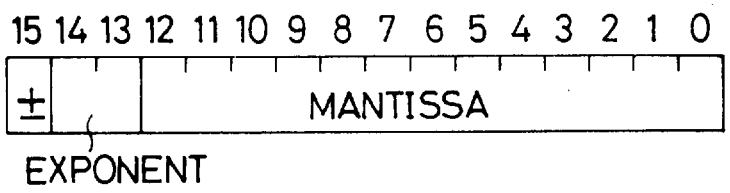
FIGS. 3A and 3B are views for the explanation of wave data usable as an option in Examples 1 to 5.

The wave memory 208 can store differential wave data $\Delta FWD_n$ of FDPCM (Floating point Differential Pulse Code Modulation) format in place of the differential wave data $\Delta WD_n$ of DPCM format. The differential wave data $\Delta FWD_n$ has the format of floating point, and is composed of sign (bit 15), exponent (bits 14,13) and mantissa (bits 12–0) as shown in FIG. 3A. The differential wave data $\Delta FWD_n$ is prepared by converting the differential wave data $\Delta WD_n$ of DPCM format to data of floating point format.

A group consisting of the specific sampling data $D_M$ and a plurality of the differential wave data $\Delta WD_n$ (n=1, 2, 3, . . . , M−1, M+1, . . . N−2, N−1) will be referred to as "wave data group" hereinafter. One wave data group corresponds to one timbre. Further, the specific sampling data $D_M$ in the wave data group or one of a plurality of the differential wave data $\Delta WD_n$ will be referred to as "wave data of the wave data group".

The wave readout addresses $A_0$, $A_M$ (0<M<N−1) and $A_n$ (n=1, 2, . . . , M−1, M+1, . . . N−2, N−1) are constituted of 24 bit data. A start address SA corresponds to the wave readout address $A_0$. The start address SA designates a position where the wave data (sampling data $D_0$) at the top of the wave data group is stored in the wave memory 208. The address which corresponds to the wave readout address $A_M$ is referred to as loop top address LT. The loop top address LT designates a position where the specific sampling data $D_M$ is stored in the wave memory 208.

Figure 5:
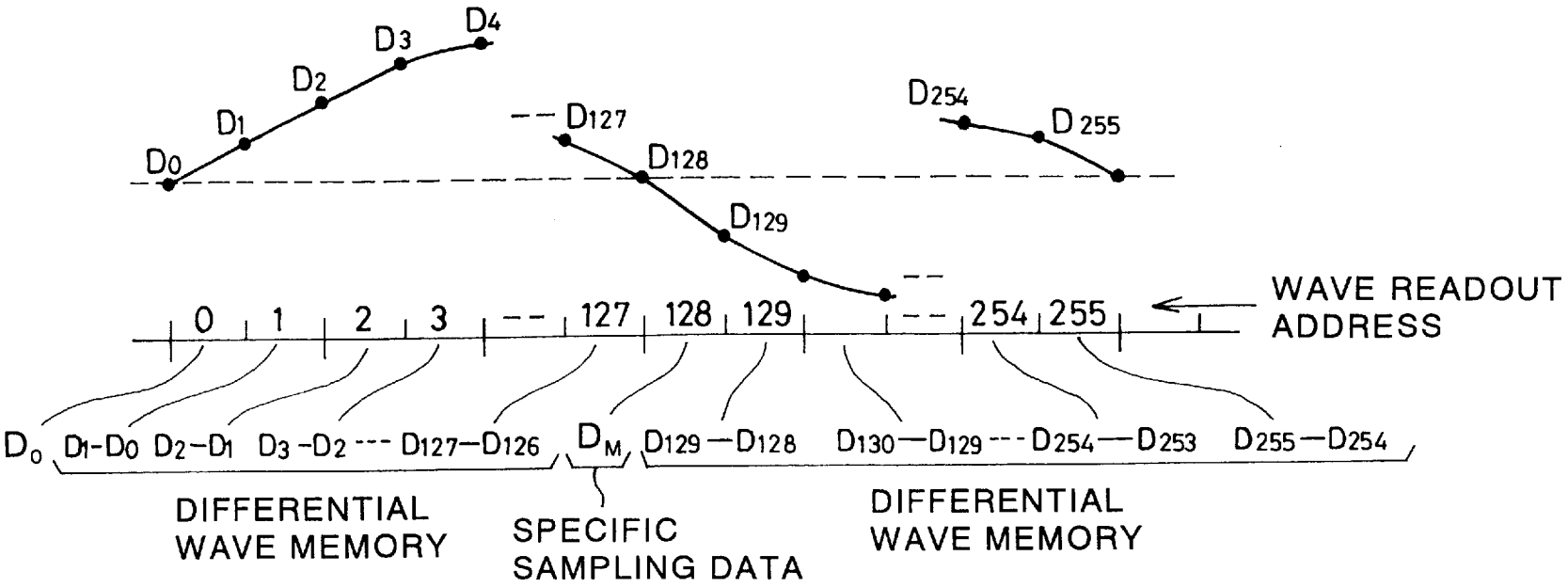
FIG. 5 is a view showing an example of storing wave data in a wave memory in Examples 1 to 5.
Figure 6:
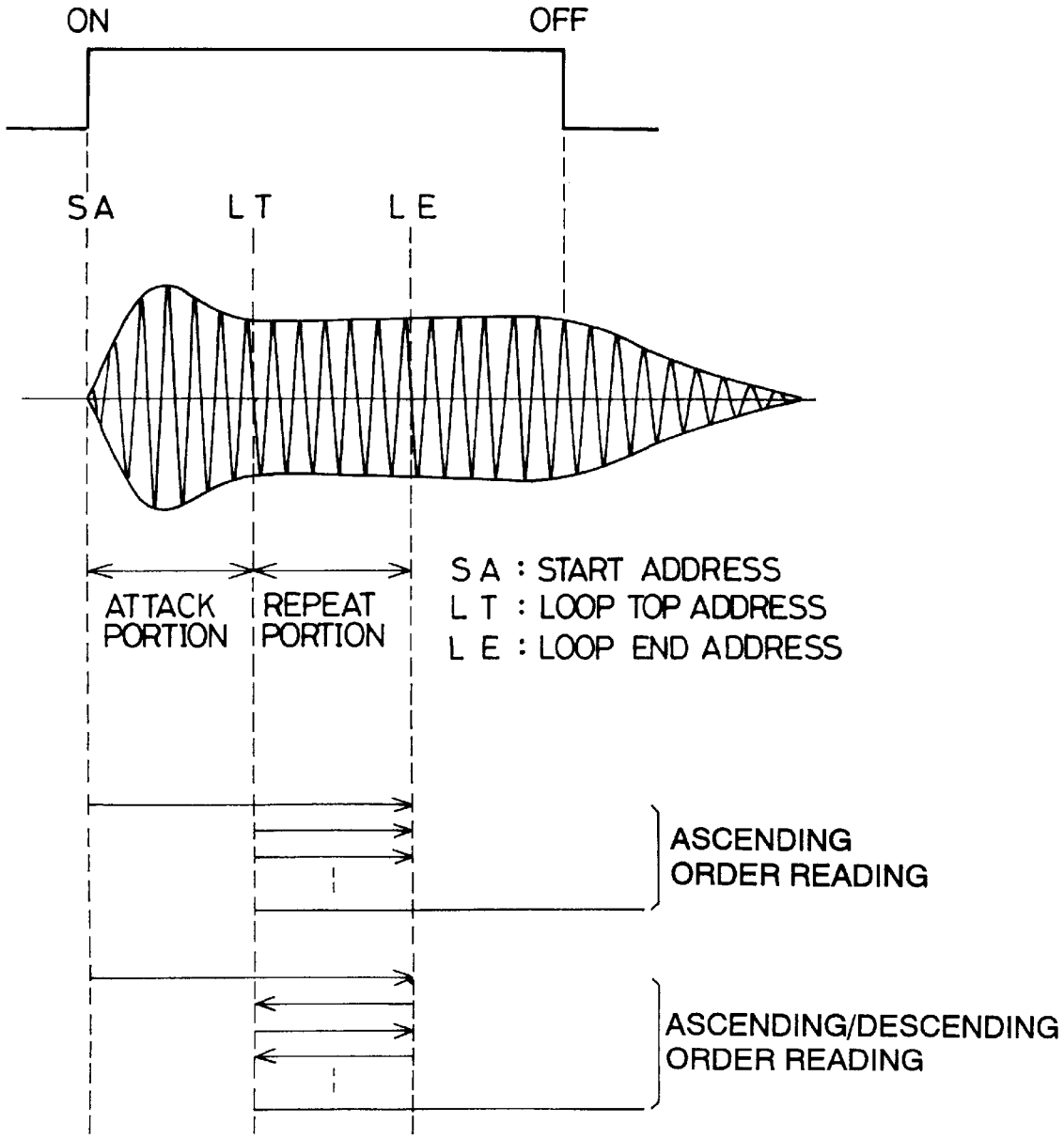
FIG. 6 is a view for the explanation of a method for preparing, and a method for reading out, wave data in the present invention.

FIG. 5 shows how the sampling data $D_0$, the specific sampling data $D_M$ and the differential wave data $\Delta WD_n$ are stored in the wave memory 208. In the sampling point $P_0$, the sampling data $D_0$ of PCM format is directly stored in a position designated by the wave readout address "0" in the wave memory 208. In the sampling point $P_{128}$, the specific sampling data $D_M$ of PCM format is stored in a position designated by the wave readout address "128" in the wave memory 208. The specific sampling data $D_M$ is zero in Example 1, while it shall not be limited to zero. In other sampling points $P_i$ (i=1, 2, . . . 127, 129 . . . ), the sampling data $D_{n-1}$ is deducted from the sampling data $D_n$, whereby the differential wave data $\Delta WD_n$ (n=1, 2, . . . , 127, 129, . . . ) of DPCM format are obtained, and these are stored in positions designated by wave readout addresses "1", "2", . . . "127", "129" . . . in the wave memory 208. In Example 1, the start address SA is "0". The loop top address LT is "128". The content of the wave memory 208 designated by the loop top address LT ("128") is the specific sampling data $D_M$.

(1) Explanation of decoding circuit

Figure 1:
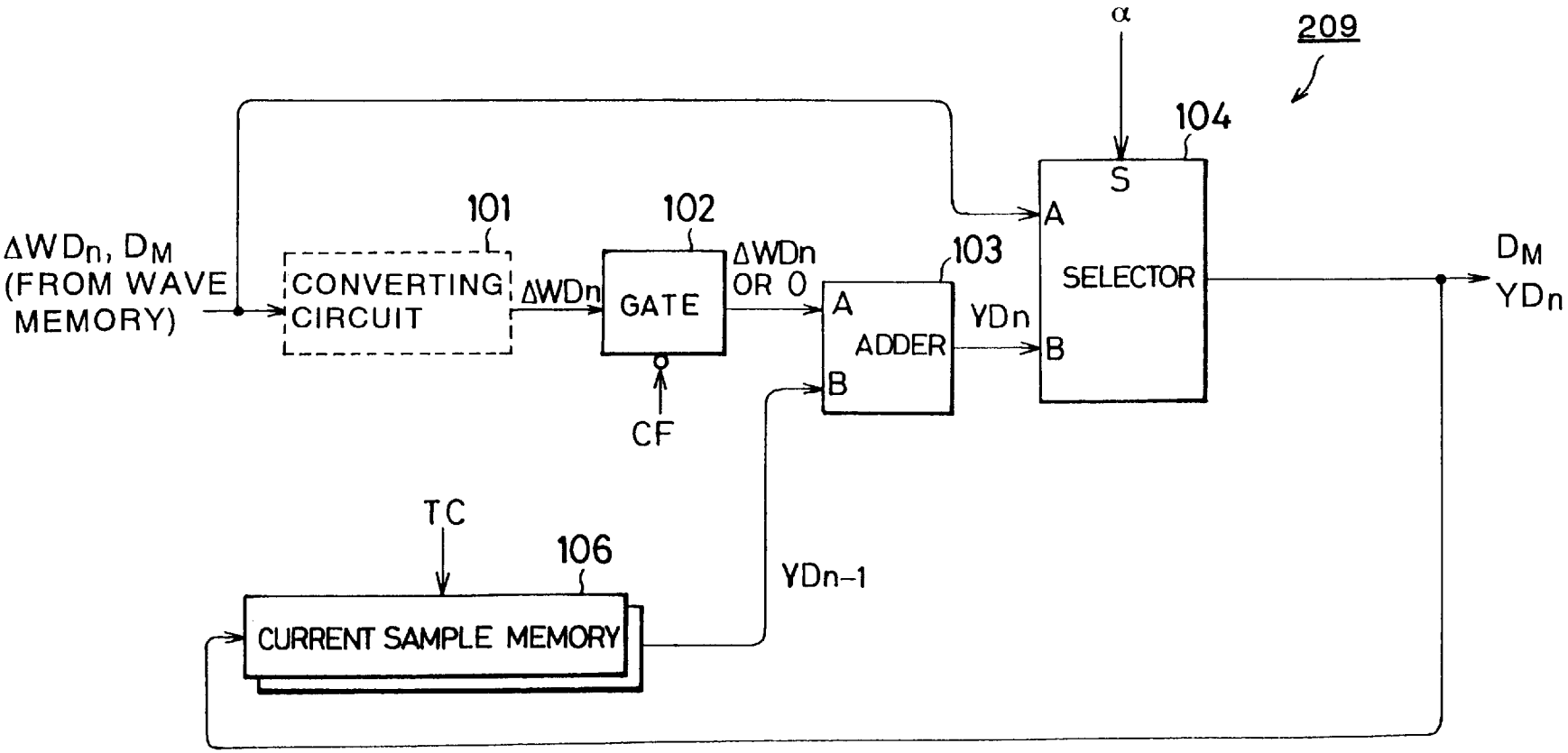
FIG. 1 is a block diagram of a decoding circuit used in a tone generation circuit in Examples 1 to 5.
Figure 2:
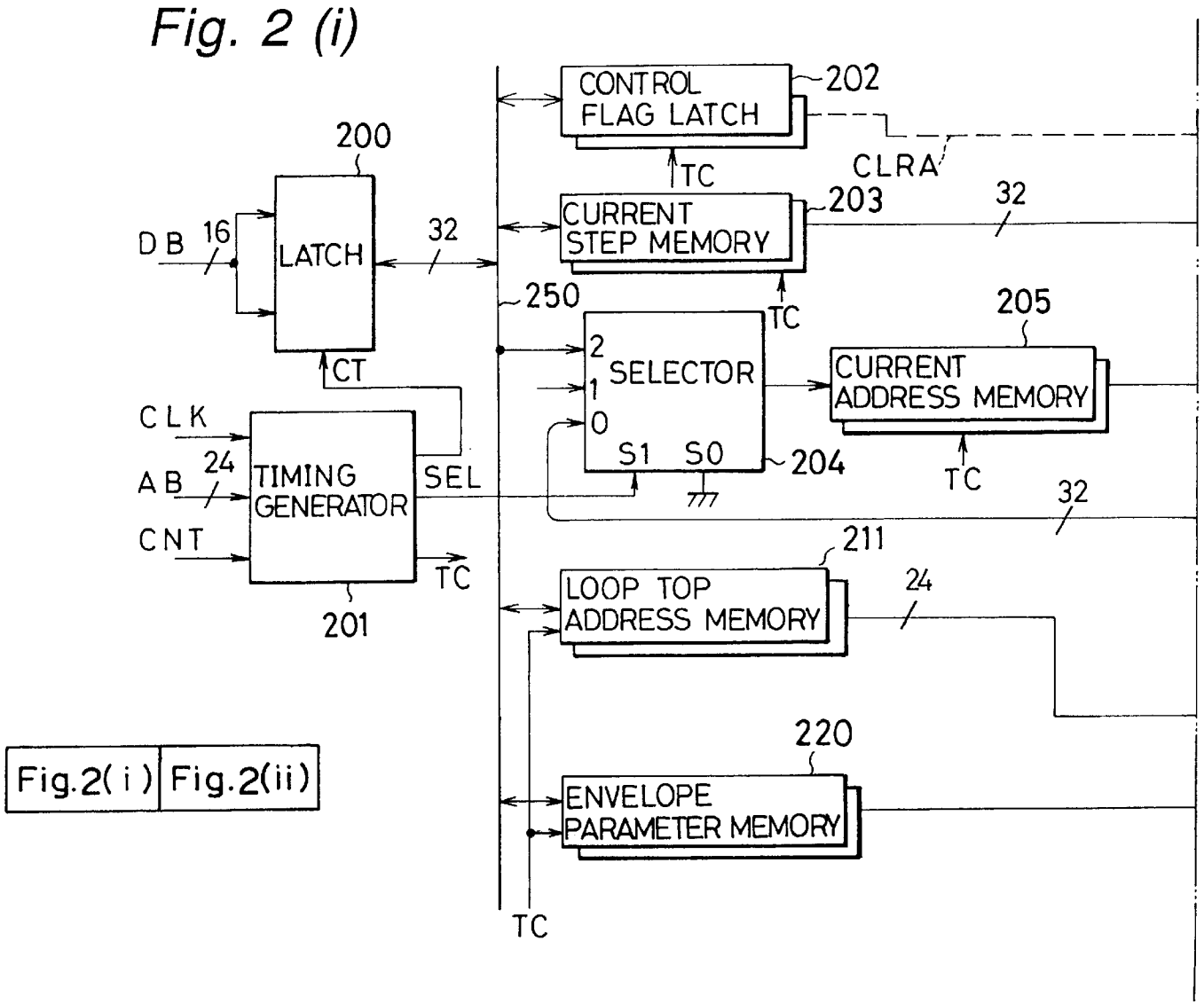
FIGS. 2(*i*) and 2(*ii*) are block diagrams of a tone generation circuit in Example 1.

FIG. 1 is a block diagram of a decoding circuit 209 used in a tone generation circuit (see FIG. 2). The decoding circuit 209 corresponds to the decoding means and the temporary storage means.

Figure 3B:
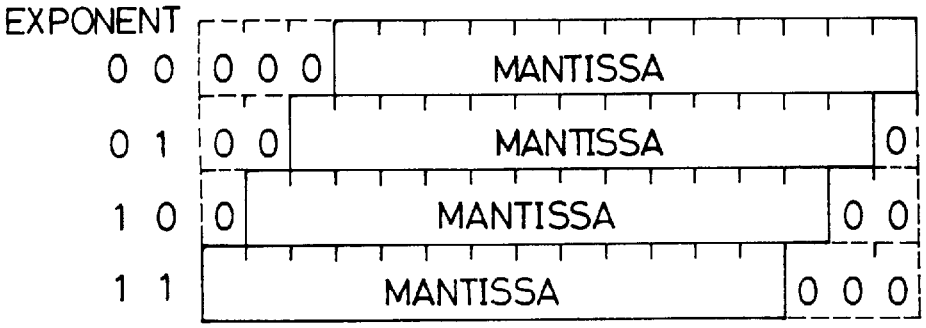

In FIG. 1, a converting circuit 101 is optional. The converting circuit 101 is required when the wave memory 208 stores the differential wave data $\Delta FWD_n$ of FDPCM format. The converting circuit 101 converts the differential wave data $\Delta FWD_n$ of FDPCM format from the wave memory 208 to the differential wave data $\Delta WD_n$ of DPCM format. This conversion is carried out by shifting leftward the value of a mantissa portion according to the value of an exponent portion of the differential wave data $\Delta FWD_n$, for example, as schematically shown in FIG. 3. The differential wave data $\Delta WD_n$ obtained by the conversion has a fixed point format and is data of 2's complement format. When the converting circuit 101 receives the specific sampling data $D_M$ from the wave memory 208, the converting circuit 101 outputs converted specific sampling data. However, the converted specific sampling data is not used for generating a musical tone signal. The presence of the converting circuit 101 will be omitted from explanations hereinafter. The differential wave data $\Delta WD_n$ and the specific sampling data $D_M$ from the wave memory 208 are supplied to a gate 102 and an input terminal A of a selector 104.

A current sample memory 106 corresponds to the temporary storage means. In the current sample memory 106, the differential wave data is accumulated. It is supposed here that the differential wave data $\Delta WD_{n-1}$ has been accumulated in the current sample memory 106 and that the sampling data $YD_{n-1}$ has been reproduced and stored in the current sample memory 106. The current sample memory 106 is composed of a plurality of blocks. One block corresponds to one tone generating channel. The number of the blocks equals the number of time-divisions. Timing signal TC from a timing generator 201 (see FIG. 2) selects one of the blocks. This constitution will be referred to as "time-sharing construction" hereinafter. The sampling data $YD_{n-1}$ from the current sample memory 106 is supplied to an input terminal B of an adder 103.

When the value of identity signal CF is "0", the gate 102 passes the differential wave data $\Delta WD_n$ or the specific sampling data $D_M$ from the wave memory 208 as it is. On the other hand, when the value of the identity signal CF is "1", "zero" is outputted. The value of the identity signal CF is "1" when the value of the wave readout address is the same as a previous one, and "0" in the other cases. The identity signal CF is generated by a comparator 210 (see FIG. 2). It is decided on the basis of the value of the identity signal CF whether or not the differential wave data $\Delta WD_n$ is accumulated on the sampling data $YD_{n-1}$. The output from the gate 102 is supplied to the input terminal A of the adder 103.

The adder 103 adds the output from the gate 102 to the sampling data $YD_{n-1}$, to give the sampling data $YD_n$. The sampling data $YD_n$ is supplied to an input terminal B of the selector 104.

The selector 104 selects the input terminal A or the input terminal B depending upon the value of control signal $\alpha$. The value of the control signal $\alpha$ is "1" when the wave readout address $A_M$ is generated, and "0" in the other cases (to be described in detail later). When the wave readout address $A_0$ is generated, the value of control signal $\alpha$ is forced to "1" by a control circuit (not shown). When the selector 104 receives the control signal a having a value of "1", the selector 104 selects the input terminal A, whereby the selector 104 supplies the sampling data $D_0$ or the specific sampling data $D_M$ to the current sample memory 106. On the other hand, when the selector 104 receives the control signal $\alpha$ having a value of "0", the selector 104 selects the input terminal B, whereby the selector 104 supplies the sampling data $YD_n$ to the current sample memory 106. As a result, the sampling data $D_0$, the specific sampling data $D_M$ or the sampling data $YD_n$ is stored in the current sample memory 106. The output from the selector 104 is also supplied to a multiplier 230 (see FIG. 2).

(2) Explanation of tone generation circuit

FIG. 2 is a block diagram of the tone generation circuit in Example 1. The constitution and operation of the tone generation circuit will be explained in detail with reference to the block diagram shown in FIG. 2 hereinafter.

In FIG. 2, a CPU and the tone generation circuit are connected to each other through a 16 bit data bus DB, a 24 bit address bus AB and a control data bus CNT. A latch 200 is a bi-direction 3-state latch. The latch 200 is used for controlling the transmission and receiving of data between the CPU and the tone generation circuit. The tone generation circuit handles 32 bit data. The CPU transmits upper 16 bit data to the tone generation circuit, and then, transmits lower 16 bit data to the tone generation circuit. The latch 200 consecutively receives 16 bit data from the data bus D, and transfers the data to an internal bus 250 when the data comes up to 32 bits. On the other hand, when data is transmitted from the tone generation circuit to the CPU, 32 bit data is set in the latch 200. Upper 16 bits of data set in the latch 200 are outputted to the data bus DB, and then, lower 16 bits of the data set in the latch 200 are outputted to the data bus DB. The latch-timing and transmission directions of the latch 200 are controlled by a control signal CT from the timing generator 201.

The timing generator 201 receives a clock signal CLK from a clock generator (not shown), address data from the CPU through the address bus AB and control data from CPU through the control data bus CNT, and generates control signals for controlling each part of the tone generation circuit. Specifically, the timing generator 201 generates the control signal CT for controlling the latch 200, a control signal SEL for controlling a selector 204 and a timing signal TC. The timing signal TC is used, for example, for selecting one of 32 tone generating channels when the tone generation circuit is constituted so as to operate on the basis of time-sharing of the 32 tone generating channels. The timing signal TC is supplied to various memories and circuits which have time-sharing constitutions.

A control flag latch 202 has a time-sharing constitution, and stores data from the CPU. A clear signal CLRA from the control flag latch 202 is supplied to a clear circuit 207. The content of the control flag latch 202 is cleared when a first timing signal TC is generated. As will be described later, the control flag latch 202 is not required for a signal generating apparatus having a constitution free of the clear circuit 207, since the clear signal CLRA is not used.

The address generating means of Example 1 is constituted of a current step memory 203, the selector 204, a current address memory 205, an adder 206 and the clear circuit 207. The address generating means generates the wave readout address $A_0$, $A_M$ or $A_n$ (24 bits each) in an ascending order on the basis of extended wave readout address (32 bits) prepared inside it. The extended wave readout address is composed of the wave readout address $A_0$, $A_M$ or $A_n$ and 8 bit data added to a low-order side thereof. The added 8 bit data will be referred to as "fraction address". The address generating means consecutively generates the wave readout address $A_0, A_1, \ldots, A_{M-1}, A_M, A_{M+1}, \ldots, A_{N-1}$.

The current step memory 203 has a time-sharing constitution, and stores F number from the CPU. The term "F number" refers to 32 bit data which defines the pitch (frequency) of a musical tone. Specifically, the F number is an increment value of the extended wave readout address when the wave readout address $A_M$ or $A_n$ are generated in an ascending order. The current step memory 203 is controlled by a control circuit (not shown) to output zero while the value of the clear signal CLRA is "1". The output (F number or zero) from the current step memory 203 is supplied to an input terminal A of the adder 206.

The selector 204 has three input ports (port 0–port 2). Each input port is selected depending upon a control signal supplied to the control input terminals S1 and S0. The following Table 1 shows the relationship between the control signals and input ports selected.

TABLE 1

| <S1> | <S0> | <Input port to be selected> |
|---|---|---|
| 0 | 0 | port 0 (subsequent extended wave readout address) |
| 0 | 1 | port 1 (not used) |
| 1 | — | port 2 (start address SA from CPU) |

The port 2 is used for selecting one wave data group from a plurality of wave data groups. The CPU transmits control data for generating the control signal SEL to the timing generator 201. At the same time, the CPU transmits the start address SA corresponding to a desired timbre to the latch 200 through the data bus DB, whereby the port 2 is selected on the basis of the control signal SEL, and the selector 204 outputs the start address SA for the wave data group. As a result, the initial value of wave readout address of the wave data group is determined. The port 0 is used for consecutively updating the extended wave readout address. The port 1 is not used in Example 1. The output from the selector 204 is supplied to the current address memory 205.

The current address memory 205 has a time-sharing constitution, and stores current extended wave readout address. Current wave readout address of the current extended wave readout address stored in the current address memory 205 indicates that position of the wave memory 208 where the differential wave data $\Delta WD_{n-1}$ accumulated in the current sample memory 106 at an immediately preceding cycle, the sampling data $A_0$ or the specific sampling data $D_M$ stored in the current sample memory 106 is stored. The current extended wave readout address (32 bits) is supplied to an input terminal B of the adder 206. The current wave readout address (upper-order 24 bits) is supplied to an input terminal B of the comparator 210.

The adder 206 adds an output from the current step memory 203 to the current extended wave readout address. The output from the adder 206 is subsequent extended wave readout address (32 bits). Subsequent wave readout address (upper-order 24 bits) of the subsequent extended wave readout address indicates that position of the wave memory 208 where the wave data of the wave data group to be read out next is stored. The output from the adder 206 is supplied to the clear circuit 207.

The clear circuit 207 is used for bringing the fraction address of the subsequent extended wave readout address from the adder 206 into zero. The clear circuit 207 is necessary when no fraction address is added to a lower-order side of the start address SA from the CPU. When the CPU transmits 32 bit data having fraction address added, the clear circuit 207 can be removed. The subsequent extended wave readout address from the clear circuit 207 is supplied to the port 0 of the selector 204. The subsequent wave readout address from the clear circuit 207 is supplied to the wave memory 208, an input terminal A of the comparator 210 and an input terminal A of a comparator 212.

As already described, the wave memory 208 stores a plurality of the differential wave data $\Delta WD_n$ of DPCM format, and the sampling data $D_0$ and the specific sampling data $D_M$ of PCM format. The content of the wave memory 208 is read out according to the subsequent wave readout address from the clear circuit 207. That is, the sampling data $D_0$, the specific sampling data $D_M$ or the differential wave data $\Delta WD_n$ designated by the subsequent wave readout address is read out from the wave memory 208. The wave sampling data $D_0$, the specific sampling data $D_M$ or the differential wave data $\Delta WD_n$ from the wave memory 208 is supplied to the decoding circuit 209. The sampling data $D_0$, the specific sampling data $D_M$ or the sampling data $YD_n$ from the decoding circuit 209 is supplied to an input terminal A of the multiplier 230.

The comparator 210 compares the current wave readout address from the current address memory 205 and the subsequent wave readout address from the clear circuit 207. The comparator 210 outputs "1" when the above addresses are in agreement, and "0" in other case. The output from the comparator 210 is supplied to the gate 102 of the decoding circuit 209 as the identity signal CF. The gate 102 is provided for preventing the duplicated addition of the differential wave data $\Delta WD_n$ to the sampling data $YD_n$. The duplicated addition may take place when wave data of the wave data group for reproducing low tones are read out at small intervals. Namely, it takes place when the value of the subsequent wave readout address does not change when the F number is added to the current extended wave readout address.

A loop top address memory 211 has a time-sharing constitution, and has stored the loop top address LT. The loop top address LT is supplied to the input terminal A of the comparator 212.

The comparator 212 compares the subsequent wave readout address from the clear circuit 207 and the loop top address LT from the loop top address memory 211. As a result of the comparison, when these addresses are in agreement, "1" is outputted as a value of the control signal $\alpha$, and "0" is outputted in other case. The control signal $\alpha$ is supplied to the selector 104 of the decoding circuit 209, whereby the specific sampling data $D_M$ is stored in the current sample memory 106 when the wave readout address $A_M$ is generated.

An envelope parameter memory 220 has a time-sharing constitution, and stores current envelope target value, envelope addition value and loudness value. The contents of the envelope parameter memory 220 is read out by an envelope generator 221. A current envelope memory 222 has a time-sharing constitution, and stores a current envelope value which is an intermediate result of envelope operation.

The signal generating means in Example 1 is constituted of the envelope generator 221 and the multiplier 230. The envelope generator 221 adds the envelop addition value from the envelope parameter memory 220 to the current envelope value from the current envelope memory 222 on a time-sharing basis. The envelope generator 221 determines whether the operation results reaches the current envelope target value. When the operation result does not reach the current envelope target value, the operation result is stored in the current envelope memory 222 as a current envelope value for a subsequent operation. The operation result is further multiplied by the loudness value. The multiplication result is outputted from the envelop generator 221 as an envelope level EL. In this manner, the envelope generator 221 generates an envelope which asymptotically reaches the current envelope target value. The envelope level EL from the envelope generator 221 is supplied to an input terminal B of the multiplier 230.

The multiplier 230 multiplies the specific sampling data $D_M$ or the sampling data $YD_n$ from the decoding circuit 209 and the envelope level EL from the envelope generator 221. As a result of the multiplication, a musical tone signal having an envelop added is generated. The musical tone signal from the multiplier 230 is supplied to an adder system 231.

The adder system 231 allocates all the tone generating channels to at least one of four timbre systems, and adds the musical tone signal in each timbre system. The output of the adder system 231 is supplied to a digital control filter 232.

As the digital control filter 232, for example, a digital filter operable on an 8 times over-sampling basis may be employed. The output from the digital control filter 232 is supplied to a D/A converter 233. The D/A converter 233 converts an over-sampled digital signal to an analog signal for each timbre system. Each analog signal is supplied to a loudspeaker or an earphone through an amplifier (not shown).

The signal generating apparatus of Example 1 having the above constitutions will be explained. The CPU sets the start address SA in the current address memory 205 prior to the operation of the tone generation circuit. Further, the CPU sets predetermined data in the control flag latch 202, whereby the clear signal CLRA is brought into "1". In this state, the CPU transmits control data for indicating the initiation of the operation of the tone generation circuit to the timing generator 201, whereby the generation of the timing signal TC is initiated, and the operation of the tone generation circuit is initiated.

The clear signal CLRA is "1" until a first timing signal TC is generated, so that the current step memory 203 outputs zero. Therefore, the clear circuit 207 outputs the subsequent extended wave readout address having 8-bit zero added to a low-order side of the start address SA, whereby the wave readout address $A_0$ corresponding to the start address SA is generated, and the sampling data $D_0$ in a position in the wave memory 208 designated by the wave readout address $A_0$ is read out from the wave memory 208. When the wave readout address $A_0$ is generated, the value of the control signal $\alpha$ is brought into "1", so that the sampling data $D_0$ is supplied to the current sample memory 106 through the selector 104. And, concurrently with the generation of the first timing signal TC, the sampling data $D_0$ is set in the current sample memory 106, whereby the accumulation of the differential wave data $\Delta WD_n$ (wherein n=1, 2, . . . ) is initiated at an initial value $D_0$.

Thereafter, the subsequent extended wave readout addresses are consecutively updated synchronously with the timing signal TC. When the subsequent wave readout address $A_M$ corresponding to the loop top address LT is generated, the comparator 212 outputs the control signal $\alpha$ having a value of "1", whereby the specific sampling data $D_M$ is set in the current sample memory 106. Thereafter, the accumulation of the differential wave data $\Delta WD_n$ (wherein n=M+1, M+2, . . . ) is initiated at the specific sampling data $D_M$.

As explained above, in Example 1, when the wave readout address $A_M$ is generated, the specific sampling data $D_M$ is read out from the wave memory 208. And, the sampling data $YD_{M-1}$ obtained by the accumulation which has been made so far is discarded, and the accumulation is initiated at the specific sampling data $D_M$. As a result, error accumulation inherent to the DPCM method or the ADPCM method can be suppressed.

In Example 1, further, the wave memory 208 stores the specific sampling data $D_M$ in addition to the differential wave data $\Delta WD_n$. In contrast, in the musical tone generating apparatus disclosed in U.S. Pat. No. 4,916,996, the wave memory (ADPCM data memory 2) stores differential wave data alone. It is therefore required to store initial data for suppressing error accumulation entailed by the reproduction of wave data in a site other than the wave memory, so that latches 206, 218, etc., are provided. The musical tone signal generating apparatus of Example 1 is simpler than the counterpart of U.S. Pat. No. 4,916,996 in circuit constitution.

EXAMPLE 2

In Example 2, the specific sampling data $D_M$ is composed of a plurality of sampling data $D_{M1}$, $D_{M2}$, . . . of PCM format. The differential wave data $\Delta WD_n$ and the sampling data $D_{M1}$, $D_{M2}$, . . . are read out from the wave storage means once in an ascending order.

The differential wave data $\Delta WD_n$ is prepared in the same manner as in Example 1, provided that n=1, 2, 3, . . . N−2, N−1 and that n≠M1, M2, . . . . Further, a plurality of the sampling data $D_{M1}$ (0<M1<N−1), $D_{M2}$ (0<M2<N−1), . . . are selected among the sampling data $D_i$. In Example 2, as the specific sampling data $D_M$, two sampling data $D_{M1}$ and $D_{M2}$ are used.

Figure 7:
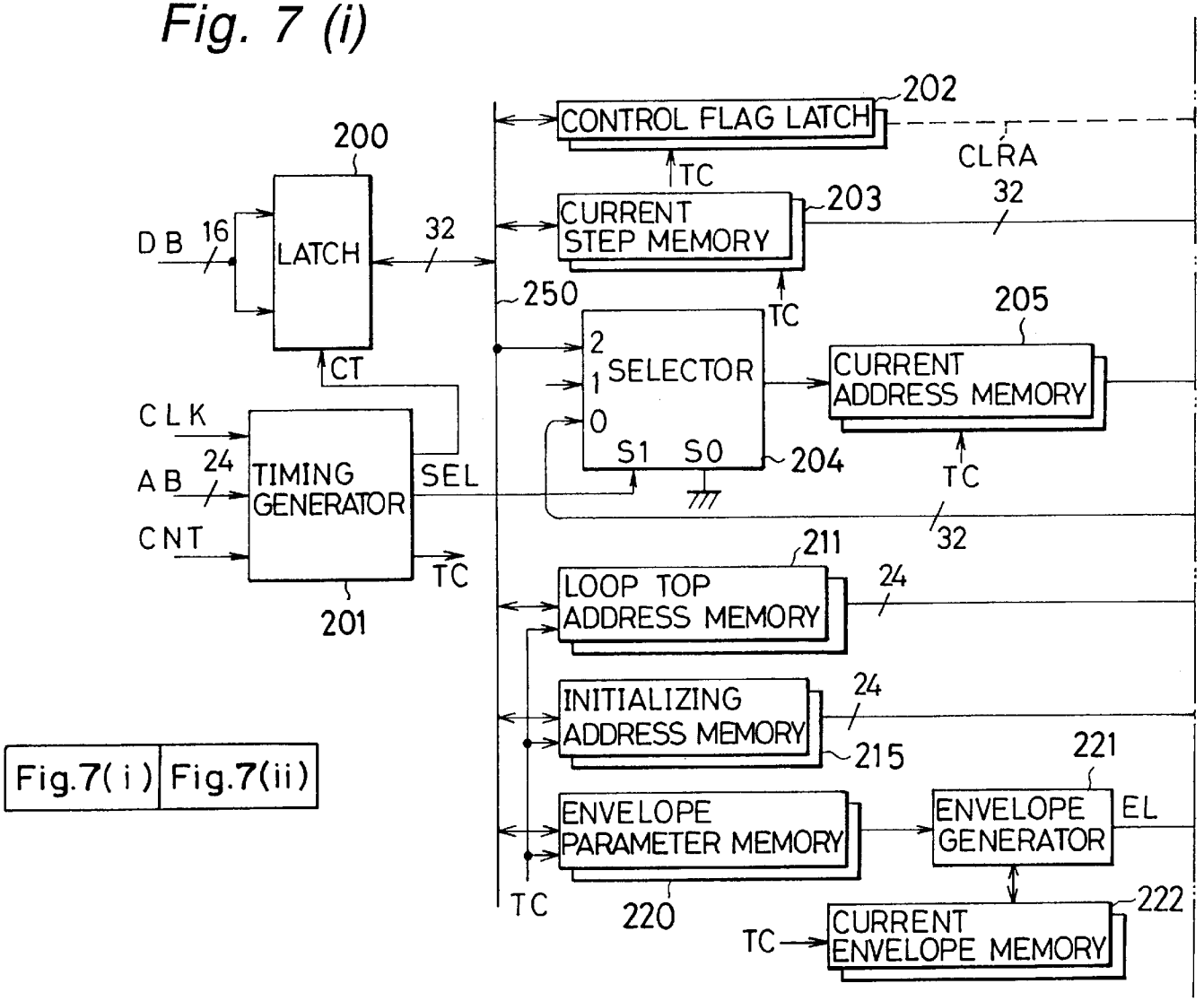
FIGS. 7(*i*) and 7(*ii*) are block diagram of a tone generation circuit in Example 2.

FIG. 7 is a block diagram of a tone generation circuit in Example 2. In this tone generation circuit, the decoding circuit 209 shown in FIG. 1 can be used as it is. The constitution and the operation of the tone generation circuit will be explained in detail with reference to the block diagram shown in FIG. 7 hereinafter.

The tone generation circuit in Example 2 has a constitution in which an initializing address memory 215, a comparator 216 and an OR gate 217 are added to the tone generation circuit in Example 1 shown in FIG. 2. Those portions and elements which are the same as, or correspond to, those in Example 1 are shown by the same reference numerals. Explanations thereof are omitted or simplified, and additional parts are mainly explained, hereinafter.

The address generating means in Example 2 is the same as that in Example 1, and generates the wave readout address $A_0$, $A_1$, . . . , $A_{M1-1}$, $A_{M1}$, $A_{M1+1}$, . . . , $A_{M2-1}$, $A_{M2}$, $A_{M2+1}$, . . . , $A_{N-1}$.

The loop top address memory 211 stores the loop top address LT for designating the specific sampling data $D_{M1}$. Further, the initializing address memory 215 stores initializing address IA for designating the specific sampling data $D_{M2}$.

The comparator 212 compares the subsequent wave readout address from the clear circuit 207 and the loop top address LT from the loop top address memory 211. When these data are in agreement, "1" is outputted, and "0" is outputted in other case. The output from the comparator 212 is supplied to one input terminal of the OR gate 217. Further, the comparator 216 compares the subsequent wave readout address from the clear circuit 207 and the initializing address IA from the initializing address memory 215. When these data are in agreement, "1" is outputted, and "0" is outputted in other case. The output from the comparator 216 is supplied to the other input terminal of the OR gate 217.

Therefore, the OR gate 217 outputs the control signal $\alpha$ having a value of "1" when the subsequent wave readout address $A_{M1}$ corresponding to the loop top address LT or the subsequent wave readout address $A_{M2}$ corresponding to the initializing address IA is generated, and it outputs the control signal $\alpha$ having a value of "0" in other case. The control signal $\alpha$ is supplied to the selector 104 of the decoding circuit 209. As a result, when the wave readout address $A_{M1}$ is generated, the specific sampling data $D_{M1}$ is read out from the wave memory 208 and stored in the current sample memory 106, and when the wave readout address $A_{M2}$ is generated, the specific sampling data $D_{M2}$ is read out from the wave memory 208 and stored in the current sample memory 106.

In Example 2, the wave memory 208 stores two specific sampling data $D_{M1}$ and $D_{M2}$ as the specific sampling data $D_M$, while it may be constituted so as to store three or more specific sampling data $D_{M1}$, $D_{M2}$, $D_{M3}$, . . . . This constitution can be accomplished by providing sets, each set consisting of an initializing address memory and a comparator, the number of sets being a number which is (number of specific sampling data−(minus) 1), and supplying the output from each comparator to the OR gate 217.

In Example 2, the current sample memory 106 is initialized in at least twice. As a result, error accumulation is suppressed more frequently, so that musical tone signals can be restored more faithfully.

EXAMPLE 3

In Example 3, the address generating means generates the wave readout address $A_0, A_1, \ldots, A_{M-1}, A_M, A_{M+1}, \ldots, A_{N-1}$, and then, generates the wave readout address $A_M$ and the wave readout address $A_n$ (wherein n=M+1, . . . N−1) in an ascending order. The differential wave data $\Delta WD_n$ (wherein n=M+1, . . . N−1) and the specific sampling data $D_M$ are repeatedly read out in an ascending orders from the wave storage means.

The differential wave data $\Delta WD_n$ and the specific sampling data $D_M$ are prepared in the same manner as in Example 1 and stored in the wave memory 208.

Loop end address LE is newly defined below. The loop end address LE corresponds to the wave readout address $A_{N-1}$. The loop end address LE designates that position in the wave memory 208 where the differential wave data $\Delta WD_{N-1}$ is stored.

A region from a position designated by the start address SA in the wave memory 208 to a position designated by an address immediately before the loop top address LT (address corresponding to wave readout address $A_{M-1}$) in the wave memory 208 is referred to as "attack portion". A region from a position designated by the loop top address LT in the wave memory 208 to a position designated by the loop end address LE in the wave memory 208 is referred to as "repeat portion".

In an embodiment shown in FIG. 5, the start address SA is "0". The loop top address LT is "128". The loop end address LE is "255". The content of the wave memory 208 designated by the loop top address LT ("128") in is the specific sampling data $D_M$.

Figure 8:
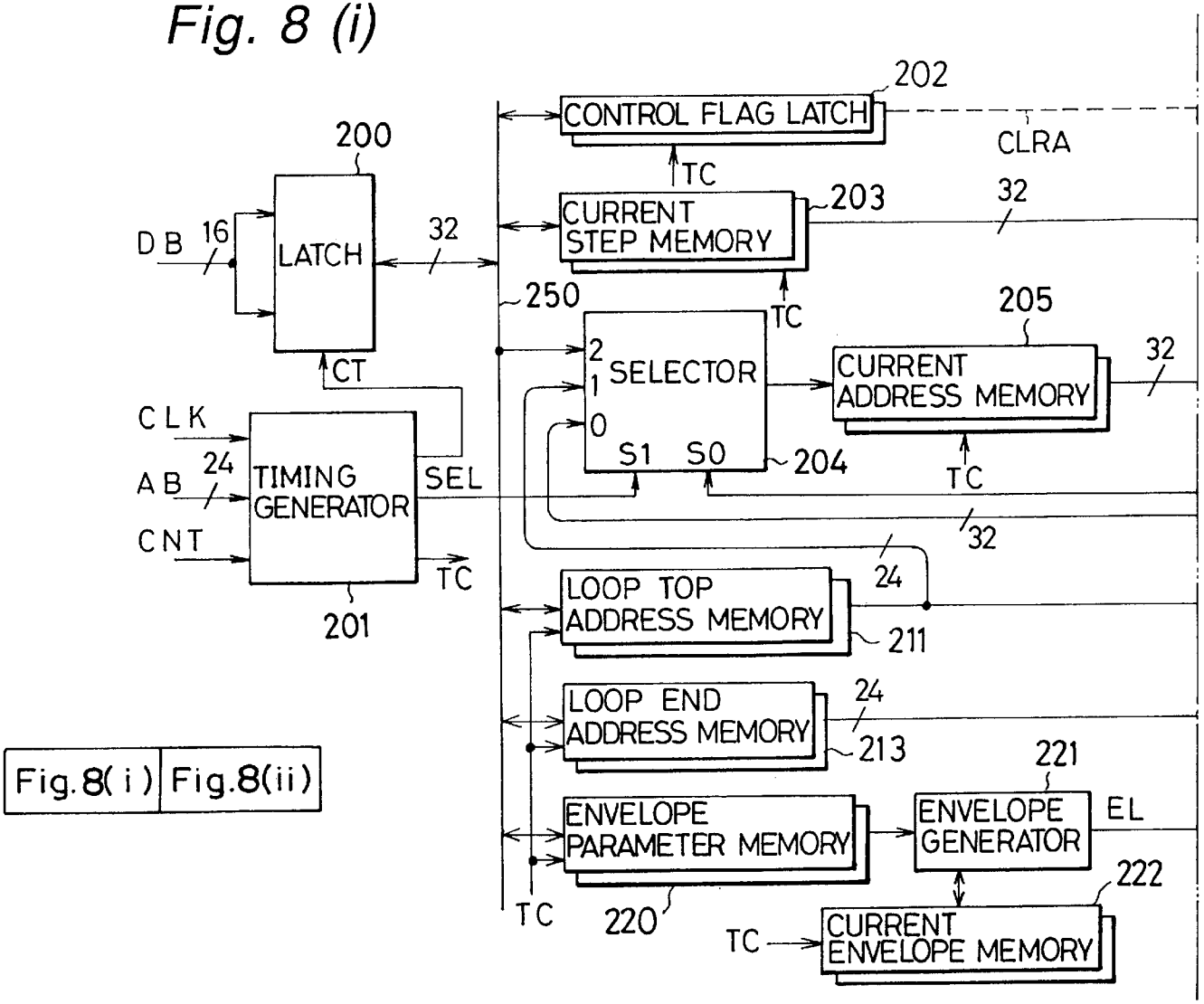
FIGS. 8(*i*) and 8(*ii*) are block diagrams of a tone generation circuit in Example 3.

FIG. 8 is a block diagram of the tone generation circuit in Example 3. In the tone generation circuit, the same decoding circuit 209 as that shown in FIG. 1 can be used. The constitution and operation of the tone generation circuit in Example 3 will be explained in detail with reference to the block diagram shown in FIG. 8 hereinafter.

The tone generation circuit in Example 3 has a constitution in which a loop end address memory 213 and a comparator 214 are added to the tone generation circuit shown in FIG. 2. In Example 3, the current step memory 203 outputs zero at a cycle subsequent to the cycle at which the wave readout address $A_{N-1}$ corresponding to loop end address LE is generated. This function is accomplished by a control circuit (not shown). Those portions and elements which are the same as, or correspond to, those in Example 1 are shown by the same reference numerals. Explanations thereof are omitted or simplified, and additional parts are mainly explained, hereinafter.

The address generating means of Example 3 is constituted of the current step memory 203, the selector 204, the current address memory 205, the adder 206, the clear circuit 207, the loop top address memory 211, the loop end address memory 213 and the comparator 214.

In Example 3, 24 bit loop top address LT is inputted to the port 1 of the selector 204. The port 1 is used for bringing back the wave readout address from the loop end address LE to the loop top address LT. When the port 1 is selected, the selector 204 outputs 32 bit data having zero of 8 bits added to a lower order side. The following Table 2 shows the relationship between the control signals and input ports selected.

TABLE 2

| <S1> | <S0> | <Input port to be selected> |
|---|---|---|
| 0 | 0 | port 0 (subsequent extended wave readout address) |
| 0 | 1 | port 1 (loop top address LT) |
| 1 | — | port 2 (start address SA from CPU) |

The loop end address memory 213 has a time-sharing constitution, and stores the loop end address LE. The loop end address LE from the loop end address memory 213 is supplied to an input terminal B of the comparator 214.

For detecting the end of the repeat portion, the comparator 214 compares the subsequent wave readout address from the clear circuit 207 and the loop end address LE from the loop end address memory 213. When these data are in agreement, "1" is outputted, and "0" is outputted in other case. The output from the comparator 214 is supplied to the control input terminal S0 of the selector 204.

As a result, when the subsequent wave readout address is not in agreement with the loop end address LE, the port 0 of the selector 204 is selected, and therefore, the subsequent extended wave readout address is stored in the current address memory 205, whereby the wave readout address is consecutively generated in an ascending order. On the other hand, when the subsequent wave readout address is in agreement with the loop end address LE, the port 1 of the selector 204 is selected, and therefore, the loop top address LT is stored in the current address memory 205. The subsequent cycle corresponds to a cycle subsequent to the cycle at which the wave readout address $A_{N-1}$ is generated, so that at the subsequent cycle, the current step memory 203 outputs zero. Therefore, at the subsequent cycle, the clear circuit 207 outputs the subsequent wave readout address $A_M$ corresponding to the loop top address LT, whereby the function of returning from the wave readout address $A_{N-1}$ corresponding to the loop end address LE to the wave readout address $A_M$ corresponding to the loop top address LT is accomplished.

When the wave readout address $A_M$ corresponding to the loop top address LT is generated, the control signal α having a value of "1" is outputted, and the current sample memory 106 is initialized with the specific sampling data $D_M$, which is the same as that in Example 1.

Example 3 is explained with regard to the signal generating apparatus having one specific sampling data $D_M$, while the current sample memory 106 may be initialized with a plurality of sampling data by providing at least one set which consists of an initializing address memory, and a comparator as explained in Example 2.

As explained above, in Example 3, each time when the wave readout address $A_M$ corresponding to the loop top address LT is generated, so far accumulated sampling data $YD_{N-1}$ is discarded and the accumulation is resumed at the specific sampling data $D_M$. As a result, error accumulation caused by repeated readout, inherent to the DPCM method or the ADPCM method, can be suppressed.

EXAMPLE 4

In Example 4, the address generating means generates the wave readout address $A_0, A_1, \ldots, A_{M-1}, A_M, A_{M+1}, \ldots, A_{N-1}$, and then, generates the wave readout address $A_{ud}$ (wherein ud=N−2, N−3, N−4, . . . M+1) in a descending order. The decoding means receives the differential wave data $\Delta WD_{ud+1}$ designated by the wave readout address $A_{ud+1}$ from the wave storage means, degressively deducts the differential wave data $\Delta WD_{ud+1}$ in the temporary storage means and thereby generates the sampling data $YD_{ud}$. After the address generating means generates the wave readout address $A_{M+1}$, the address generating means consecutively generates the wave readout address $A_M$ and the wave readout address $A_n$ (wherein n=M+1, M+2, . . . N−1) in an ascending order. These differential wave data $\Delta WD_n$ (wherein n=M+1, M+2, . . . N−1) and the specific sampling data $D_M$ are repeatedly read out from the wave storage means alternately in an ascending order and in a descending order. The term "degressively deducting" means "reducing the differential wave data $\Delta WD_{ud+1}$ from the sampling data $YD_{ud+1}$ stored in the temporary storage means and storing the result in the temporary storage means". The content of the temporary storage means after the storing is the sampling data $YD_{ud}$.

The differential wave data $\Delta WD_n$ and the specific sampling data $D_M$ are prepared in the same manner as in Example 1, and stored in the wave memory 208.

Figures 9, 9I:
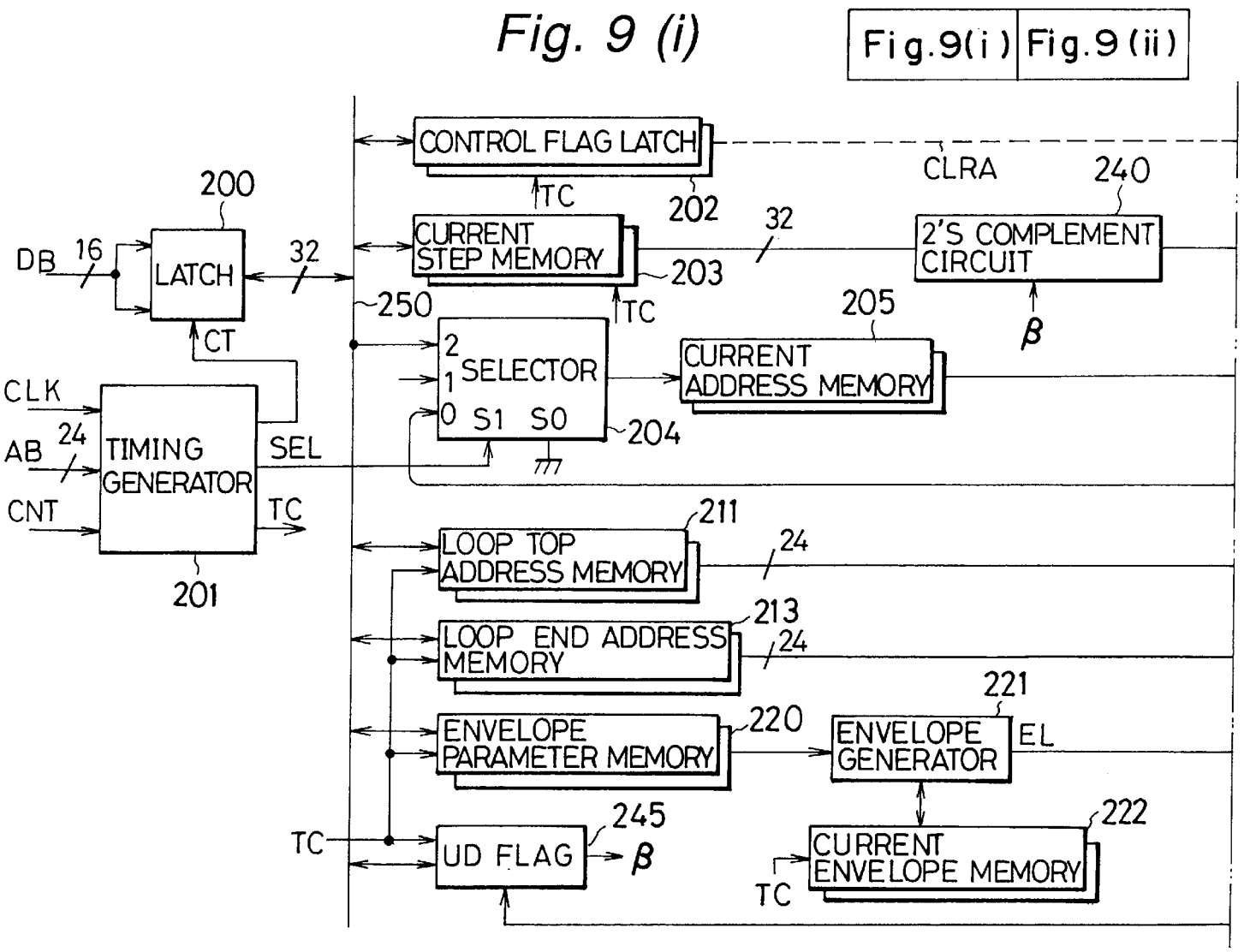
FIGS. 9(*i*) and 9(*ii*) are block diagrams of a tone generation circuit in Example 4.

FIG. 9 is a block diagram of a tone generation circuit in Example 4. In the tone generation circuit, the decoding circuit 209 as shown in FIG. 1 can be used as it is. The constitution and operation of the tone generation circuit in Example 4 will be explained in detail with reference to the block diagram shown in FIG. 9 hereinafter.

The tone generation circuit in Example 4 has a constitution in which 2's complement circuits 240 and 243, a delay circuit 241, a selector 242, an OR gate 244, an up-down flag (to be referred to as "UD flag" hereinafter) 245 and a delay circuit 246 are further added to the tone generation circuit in Example 3 shown in FIG. 8. In Example 4, unlike Example 3, the current step memory 203 as well outputs the F number at a cycle subsequent to the cycle at which the wave readout address $A_{N-1}$ corresponding to the loop end address LE is generated. Those portions and elements which are the same as, or correspond to, those in Example 3 are shown by the same reference numerals. Explanations thereof are omitted or simplified, and additional parts are mainly explained hereinafter.

The address generating means of Example 4 is constituted of the current step memory 203, the 2's complement circuit 240, the selector 204, the current address memory 205, the adder 206, the clear circuit 207, the delay circuit 241, the selector 242, the loop top address memory 211, the comparator 212, the loop end address memory 213, the comparator 214, the OR gate 244, the UD flag 245 and the delay circuit 246.

The delay circuit 246 has a constitution compatible with time-sharing, and delays a signal from the comparator 214 by one cycle. The delay circuit 246 is used for bringing a control signal β into "1" at a cycle subsequent to the cycle at which the wave readout address $A_{N-1}$ corresponding to the loop end address LE is generated. The output from the delay circuit 246 is supplied to one input terminal of the OR gate 244.

The control signal α from the comparator 212 is inputted to the other input terminal of the OR gate 244. Therefore, the OR gate 244 outputs "1" at a cycle at which the subsequent wave readout address $A_M$ corresponding to the loop top address LT is generated, or at a cycle (cycle at which the wave readout address $A_{N-2}$ is generated) subsequent to the cycle at which the subsequent wave readout address $A_{N-1}$ corresponding to the loop end address LE is generated, and outputs "0" in other case. The output from the OR gate 244 is supplied to the UD flag 245.

The UD flag 245 has a constitution compatible with time-sharing, and generates the control signal β. When the UD flag 245 is set, the control signal β is brought into "1". When the UD flag 245 is cleared, the control signal β is brought into "0". The UD flag 245 shows that the wave readout address is generated in an ascending order when it is in a cleared state (control signal β=0), and it shows that the wave readout address is generated in a descending order when it is in a set state (control signal β=1). The UD flag 245 is inverted each time when the output from the OR gate 244 is brought into "1" except for a case where the output from the OR gate 244 is brought into "1" for the first time. The control signal β from the UD flag 245 is supplied to the 2's complement circuits 240 and 243 and the selector 242.

The 2's complement circuit 240 directly outputs the output from the current step memory 203 (F number or zero) when the control signal β=0, whereby the wave readout address is generated in an ascending order. On the other hand, when the control signal β=1, it forms a 2's complement of the output (F number) from the current step memory 203 and output the 2's complement, whereby the wave readout address is generated in a descending order. The output from the 2's complement circuit 240 is supplied to the input terminal A of the adder 206.

The delay circuit 241 has a constitution compatible with time-sharing, and delays the subsequent wave readout address from the clear circuit 207 by one cycle. The delay circuit 241 is used for reading out the differential wave data $\Delta WD_{ud+1}$, designated by the wave readout address $A_{ud+1}$ delayed by one cycle, from the wave memory 208 when the wave readout address $A_{ud}$ (wherein ud=N−2, N−3, N−4, . . . M+1) is consecutively generated in a descending order. The output from the delay circuit 241 is supplied to an input terminal B of the selector 242.

The selector 242 selects one of the input terminal A and the input terminal B according to the control signal β. Specifically, the selector 242 selects the input terminal A when the control signal β=0, whereby the selector 242 outputs the wave readout address which has been generated in an ascending order. On the other hand, the selector 242 selects the input terminal B when the control signal β=1, whereby the selector 242 outputs the wave readout address which has been generated in a descending order and delayed by one cycle. The output from the selector 242 is supplied to the wave memory 208.

The 2's complement circuit 243 directly outputs the specific sampling data $D_M$ or the differential wave data $\Delta WD_n$ read out from the wave memory 208 when the control signal β=0, and it forms a 2's complement of the differential wave data $\Delta WD_{ud+1}$ read out from the wave memory 208 and outputs the 2's complement when the control signal β=1. The output from the 2's complement circuit 243 is supplied to the decoding circuit 209.

The operation of the above-constituted tone generation circuit in Example 4 will be explained. The CPU clears the UD flag 245 before it operates the tone generation circuit, whereby the control signal β is brought into "0". Then, the operation of the tone generation circuit is initiated through the same procedures as those in Example 1. In this state, the 2's complement circuit 240 directly outputs the output (F number or zero) from the current step memory 203. The 2's complement circuit 243 directly outputs the sampling data $D_0$, the specific sampling data $D_M$ or the differential wave data $\Delta WD_n$ read out from the wave memory 208. As explained in Example 1, therefore, the accumulation of the differential wave data $\Delta WD_n$ is initiated at an initial value $D_0$.

When the generation of the wave readout address is continued in this state to generate the wave readout address $A_M$ corresponding to the loop top address LT, the comparator 212 outputs the control signal α having a value of "1", whereby the OR gate 244 outputs "1", while the UD flag 245 is not inverted since the output from the OR gate 244 is the first "1". However, the specific sampling data $D_M$ read out from the wave memory 208 is stored in the current sample memory 106. The current sample memory 106 is therefore initialized with the specific sampling data $D_M$.

Further, when the generation of the wave readout address is continued to generate the wave readout address $A_{N-1}$ corresponding to the loop end address LE, the comparator 214 outputs "1". The output from the comparator 214 is delayed by the delay circuit 246 by one cycle, and supplied to the OR gate 244, whereby the OR gate 244 outputs "1" at a cycle subsequent to the cycle at which the wave readout address $A_{N-1}$ is generated. As a result, the UD flag 245 is inverted. The control signal β is therefore brought into "1".

In a state in which the control signal β is set at "1", the 2's complement circuit 240 outputs data which is a 2's complement of the F number. The adder 206 therefore deducts the F number from the current extended wave readout address from the current address memory 205. Thereafter, the wave readout address $A_{ud}$ (wherein ud=N−2, N−3, N−4, . . . M+1) is therefore consecutively generated in a descending order. The wave readout address $A_{ud}$ is delayed by the delay circuit 241 by one cycle and supplied to the wave memory 208. Actually, therefore, the differential wave data $\Delta WD_{N-1}$, $\Delta WD_{N-2}$, $\Delta WD_{N-3}$, . . . $\Delta WD_{M+2}$ designated by the wave readout addresses $A_{N-1}$, $A_{N-2}$, $A_{N-3}$, . . . $A_{M+2}$ are read out from the wave memory 208. The differential wave data $\Delta WD_{ud+1}$ read out from the wave memory 208 is formed into a 2's complement by the 2's complement circuit 243 and supplied to the decoding circuit 209. In the decoding circuit 209, therefore, the differential wave data $\Delta WD_{ud+1}$ is degressively deducted in the current sample memory 106.

In a state in which the control signal β=1, when the wave readout address is decremented to generate the wave readout address $A_M$ corresponding to the loop top address LT, the comparator 212 outputs the control signal a having a value of "1", whereby the UD flag 245 is inverted to result in the control signal β=0. Therefore, the selector 242 outputs the wave readout address $A_M$, whereby the specific sampling data $D_M$ read out from the wave memory 208 is stored in the current. sample memory 106. The wave readout address $A_n$ (n=M+1, M+2, . . . N−1) is again consecutively generated in an ascending order. In a similar manner, the wave data of the wave data group are repeatedly read out alternately in an ascending order and in a descending order.

As explained above, in Example 4, each time when the wave readout address $A_M$ corresponding to the loop top address LT is generated, the so far accumulated sampling data $YD_{M+1}$ is discarded, and the accumulation is resumed at specific sampling data $D_M$. In Example 4, the volume of the wave data can be optionally decreased to a half of those required for repeatedly reading out the wave data of the repeat portion of the wave data group in an ascending order.

The constitution of Example 4 is that each time when the wave readout address $A_M$ corresponding to the loop top address LT is generated, the current sample memory 106 is initialized with the specific sampling data $D_M$. As explained in Example 2, however, the current sample memory 106 may be initialized with a plurality of the specific sampling data by providing at least one set which consists of an initializing address memory and a comparator.

EXAMPLE 5

In Example 5, a musical tone signal is generated on the basis of a plurality of the differential wave data $\Delta WD_n$ and one specific sampling data $D_M$. Unlike Example 3 or Example 4, however, the specific sampling data $D_M$ is stored in a position ($A_M$) other than a position ($A_R$) designated by the loop top address LT in the wave memory 208. That is, the address generating means generates the wave readout address $A_0$, $A_1$, . . . , $A_{M-1}$, $A_M$, $A_{M+1}$, . . . , $A_{N-1}$, and then, consecutively generates the wave readout address $A_n$ (wherein n=R, R+1, . . . M−1, M+1, . . . N−1 and R is determined so as to satisfy that the sampling data $D_{R-1}$ equals the sampling data $D_{N-1}$) and the wave readout address $A_M$ in an ascending order. In the position ($A_R$) in the wave memory 208 designated by the loop top address LT, the differential wave data $\Delta WD_R$ is stored. These differential wave data $\Delta WD_n$ (wherein n=R, R+1, . . . M−1, M+1, . . . N−1) and the specific sampling data $D_M$ are repeatedly read out from the wave memory 208 in an ascending order.

The differential wave data $\Delta WD_n$ is prepared in the same manner as in Example 1. The specific sampling data $D_M$ (wherein 0<M<N−1) is selected among the sampling data $D_i$ which is in the repeat portion and excludes its top and end. That is, "M" satisfies the relationship of R<M<N−1. As a content of the specific sampling data $D_M$, for example, zero can be used. These differential wave data $\Delta WD_n$ and the specific sampling data $D_M$ are stored in the wave memory 208.

Figure 10:
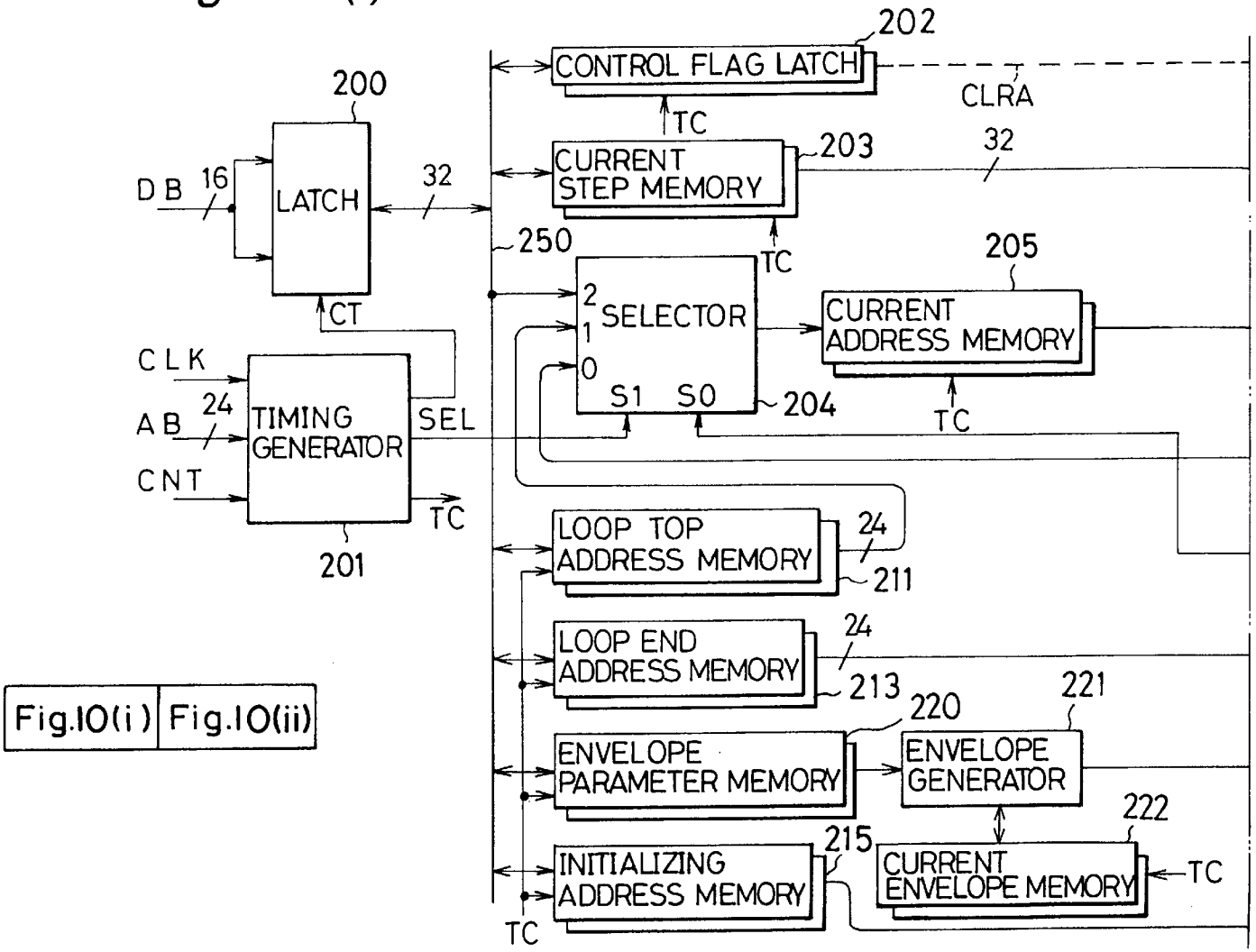
FIGS. 10(*i*) and 10(*ii*) are block diagrams of a tone generation circuit in Example 5.

FIG. 10 is a block diagram of a tone generation circuit in Example 5. In the tone generation circuit, the decoding circuit 209 shown in FIG. 1 can be used as it is. The decoding circuit 209 corresponds to the decoding means and the temporary storage means. The constitution and operation of the tone generation circuit in Example 5 will be explained in detail with reference to the block diagram shown in FIG. 10 hereinafter.

The tone generation circuit in Example 5 has a constitution in which the comparator 212 is removed from the tone generation circuit of Example 3 shown in FIG. 8 and further, the initializing memory 215 and the comparator 216 are added to the tone generation circuit shown in FIG. 8. Those portions and elements which are the same as, or similar to, those shown in FIG. 8 are shown by the same reference numerals. Examples thereof are omitted or simplified, and the additional parts are mainly explained below.

The address generating means of Example 5 is constituted of the current step memory 203, the selector 204, the current address memory 205, the adder 206, the clear circuit 207, the loop top address memory 211, the loop end address memory 213 and the comparator 214.

The initializing address memory 215 stores the initializing address IA for designating the specific sampling data $D_M$. The initializing address IA is supplied to an input terminal B of the comparator 216. The comparator 216 compares the subsequent wave readout address from the clear circuit 207 and the initializing address IA. When these data are in agreement, the comparator 216 outputs the control signal $\alpha$ having a value of "1", and outputs the control signal $\alpha$ having a value of "0" in other case.

The initializing address IA may be stored in a predetermined memory in advance. And, the tone generation circuit may have a constitution in which the CPU reads out the initializing address IA from the above memory and loads it in the initializing address memory 215 prior to reading out the wave data of the wave data group.

The operation of the tone generation circuit having the above constitution in Example 5 will be explained below. The operation of the tone generation circuit is initiated in the same manner as in Example 1, whereby the readout of wave data of the wave data group in an ascending order is initiated. When the wave readout address $A_M$ is then generated, the comparator 216 outputs the control signal $\alpha$ having a value of "1", whereby the specific sampling data $D_M$ read out from the wave memory 208 is stored in the current sample memory 106 and the current sample memory 106 is initialized. Subsequently thereto, the generation of the wave readout address is continued, and the differential wave data $\Delta WD_n$ read out from the wave memory 208 is consecutively accumulated in the current sample memory 106. After the wave readout address $A_{N-1}$ corresponding to the loop end address LE is generated, the operation returns to generate the wave readout address $A_R$ corresponding to the loop top address LT in the same manner as in Example 3. This operation is repeated hereinafter.

In Example 5, it is not required to store the specific sampling data $D_M$ in a position designated by the loop top address LT in the wave memory 208, so that the room for the selection of the specific sampling data $D_M$ can be broadened.

EXAMPLE 6

Example 6 is directed to a signal generating apparatus and a signal generating method according to the second aspect of the present invention, and a musical tone signal is generated on the basis of a plurality of differential wave data $\Delta Wd_n$ prepared by a linear prediction method and one specific sampling data $D_M$. These differential wave data $\Delta Wd_n$ and specific sampling data $D_M$ are read out from the wave storage means once in an ascending order.

Figure 12:
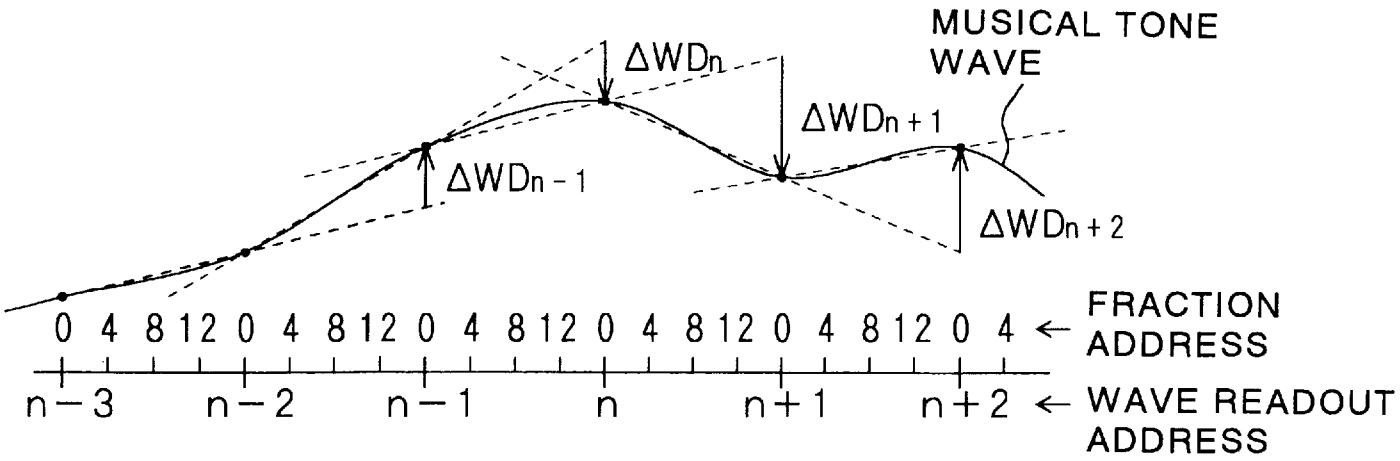
FIG. 12 is a view for the explanation of a method for preparing wave data in Examples 6 to 9.

The specific sampling data $D_M$ used in Example 6 is selected in the same manner as in Example 1. On the other hand, the differential wave data $\Delta Wd_n$ are prepared as follows. First, the sampling data $D_i$ (i=0, 1, 2, . . . N−1) are prepared in the same manner as in Example 1. Then, the differential wave data $\Delta Wd_n$ is prepared. Example 6 uses a quadratic linear prediction method. Therefore, degree q=2, and the differential wave data $\Delta Wd_n$ is prepared on the basis of the following Equation (2').

$$\Delta Wd_n = D_n - (\gamma_1 D_{n-1} + \gamma_2 D_{n-2}) \qquad \text{Equation (2')}$$

wherein n=2, 3, . . . , M−1, M+1, . . . N−2, N−1. The differential wave data $\Delta Wd_n$ is expressed by 2's complement format, and it can be therefore expressed as a positive number or a negative number, for example, as shown in FIG. 12. The so-prepared differential wave data $\Delta Wd_n$ and the specific sampling data $D_M$ are stored in the wave memory 208. The wave memory 208 corresponds to the wave storage means. Since the differential wave data $\Delta Wd_0$ and $\Delta Wd_1$ cannot be calculated on the basis of the Equation (2'), the wave memory 208 stores sampling data $D_0$ and $D_1$ in place of the differential wave data $\Delta Wd_0$ and $\Delta Wd_1$.

(1) Explanation of decoding circuit

Figure 11:
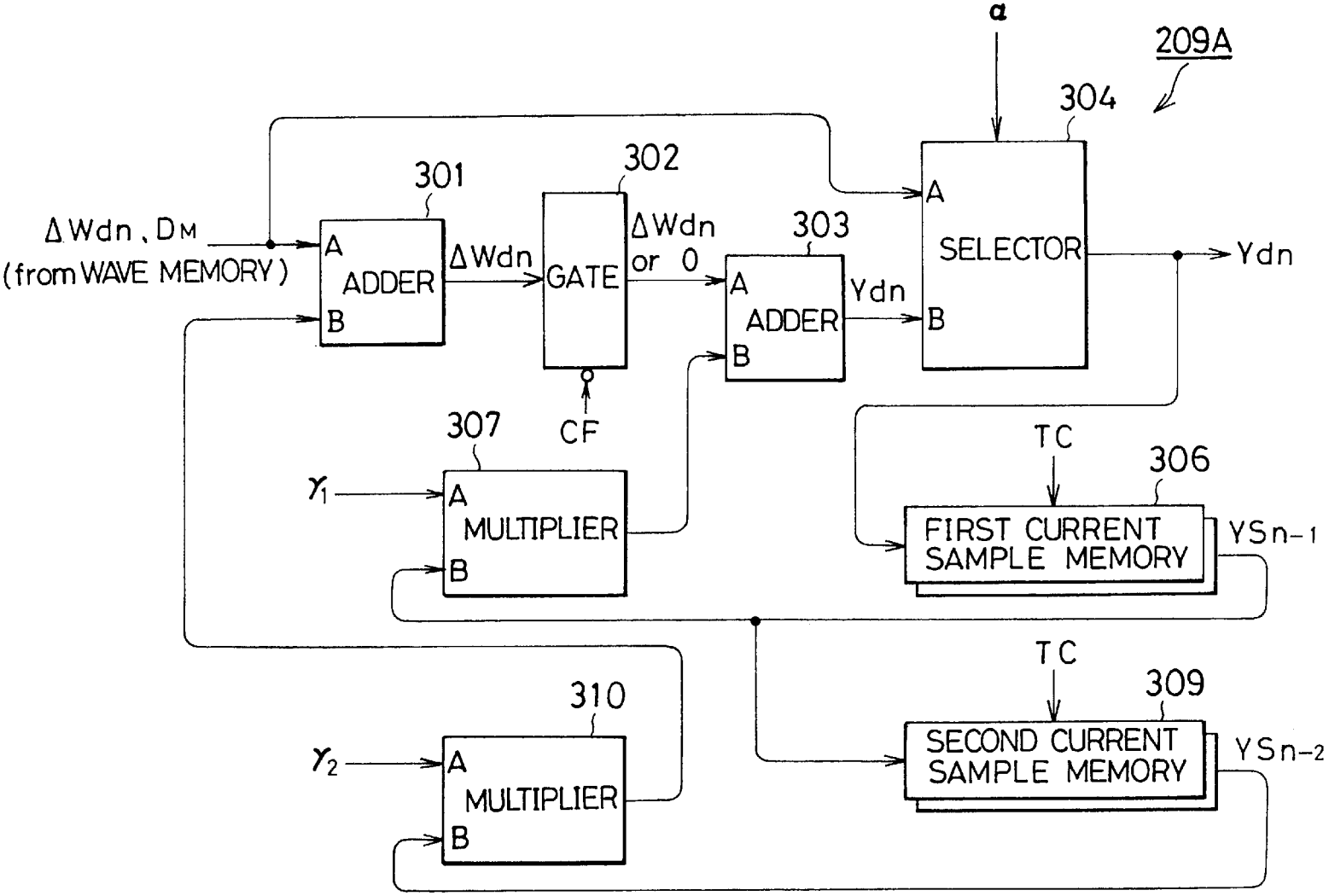
FIG. 11 is a block diagram of a decoding circuit applied to tone generation circuits in Examples 6 to 9.

FIG. 11 is a block diagram of a decoding circuit 209A in Example 6. The decoding circuit 209A corresponds to the decoding means and the temporary storage means. The decoding circuit 209A generates sampling data $Yd_n$ according to the following Equation (3').

$$Yd_n = \Delta Wd_n + (\gamma_1 YS_{n-1} + \gamma_2 YS_{n-2}) \qquad \text{Equation (3')}$$

In FIG. 11, a first current sample memory 306 and a second current sample memory 309 have a time-sharing constitution, and correspond to the temporary storage means. Further, the first current sample memory 306 corresponds to the memory area $S_1$, and the second current sample memory 309, to the memory area $S_2$. It is assumed here to obtain the sampling data $Yd_n$. In this case, the content of the first current sample memory 306 is the sampling data $Yd_{n-1}$ generated in a previous time. The content of the second current sample memory 309 is the sampling data $Yd_{n-2}$ generated in a previous time but one.

The content $YS_{n-1}$ of the first current sample memory 306 is supplied to an input terminal B of a multiplier 307. The content $YS_{n-2}$ of the second current sample memory 309 is supplied to an input terminal B of a multiplier 310.

The multiplier 307 multiplies the content $YS_{n-1}$ (sampling data $Yd_{n-1}$) of the first current sample memory 306 and the linear predictive coefficient $\gamma_1$. The output from the multiplier 307 is supplied to an input terminal B of an adder 303. The multiplier 310 multiplies the content $YS_{n-2}$ (sampling data $Yd_{n-2}$) of the second current sample memory 309 and the linear predictive coefficient $\gamma_2$. The output from the multiplier 310 is supplied to an input terminal B of an adder 301. As the linear predictive coefficient $\gamma_1$ and the linear predictive coefficient $\gamma_2$, those used for preparing the differential wave data $\Delta Wd_n$ can be used as they are. These linear predictive coefficients $\gamma_1$ and $\gamma_2$ may be stored in a ROM or a register (not shown).

The adder 301 adds differential wave data $\Delta Wd_n$ from the wave memory 208 or the specific sampling data $D_M$ to the output from the multiplier 310. This addition result is supplied to an input terminal A of the adder 303 through a gate 302. The adder 303 adds the output from the gate 302 to the output from the multiplier 307, whereby the sampling data $Yd_n$ is obtained. The sampling data $Yd_n$ from the adder 303 is supplied to an input terminal B of a selector 304.

The selector 304 has the same function as that of the selector 104 in Example 1. The value of the control signal $\alpha$ is "1" when the wave readout address $A_M$ is generated, and it is "0" in other case. The details will be described later. The value of the control signal $\alpha$ is also forced to "1" with a control circuit (not shown) when the wave readout address $A_0$ or $A_1$ is generated. The selector 304 outputs the sampling data $D_0$ or $D_1$ or the specific sampling data $D_M$ when the value of the control signal $\alpha$ is "1". On the other hand, the selector 304 outputs the sampling data $Yd_n$ when the value of the control signal $\alpha$ is "0". The output from the selector 304 is supplied to the first current sample memory 306. When the sampling data $D_0$ or $D_1$ or the specific sampling data $D_M$ is read out from the wave memory 208, the value of the control signal $\alpha$ is "1", and therefore, the data to be supplied to the input terminal B of the selector 304 through the adder 301, the gate 302 and the adder 303 is discarded.

The constitution and the function of the gate 302 are the same as those of the gate 102 in Example 1.

(2) Explanation of tone generation circuit

Example 6 uses the same tone generation circuit as the tone generation circuit shown in FIG. 2. According to the instruction from the CPU, the address generating means generates the wave readout address $A_0, A_1, \ldots, A_{M-1}, A_M, A_{M+1}, \ldots, A_{N-1}$ in the same operation as that in Example 1.

The operation of the signal generating apparatus in Example 6 will be explained with reference to FIGS. 2 and 11 hereinafter. The tone generation circuit initiates its operation as explained in Example 1. The address generating means first generates the wave readout address $A_0$ corresponding to start address SA, whereby the sampling data $D_0$ in a position designated by the wave readout address $A_0$ in the wave memory 208 is read out from the wave memory 208. Further, when the wave readout address $A_0$ is generated, the value of the control signal $\alpha$ is "1", so that the sampling data $D_0$ is supplied to the first current sample memory 306 through the selector 304. And, concurrently with the generation of a first timing signal TC, the sampling data $D_0$ is set in the first current sample memory 306.

In the subsequent cycle, the value of the clear signal CLRA is "0", and the current step memory 203 therefore outputs the F number. Therefore, the address generating means generates the wave readout address $A_1$, whereby the sampling data $D_1$ in a position designated by the wave readout address $A_1$ in the wave memory 208 is read out from the wave memory 208. When the wave readout address $A_1$ is generated, the value of the control signal $\alpha$ is "1", so that when a timing signal TC is generated, the content of the first current sample memory 306 is moved to the second current sample memory 309. Then, the sampling data D, is set in the first current sample memory 306.

In the above operations, the contents of the first current sample memory 306 and the second current sample memory 309 are respectively initialized with the sampling data $D_1$ and $D_0$. Thereafter, synchronously with the timing signal TC, the subsequent extended wave readout address is consecutively updated. Thereafter, the generation of the sampling data $Yd_n$ is therefore initiated on the basis of the initial values set in the first current sample memory 306 and the second current sample memory 309.

When the address generating means generates the wave readout address $A_M$, the comparator 212 outputs the control signal $\alpha$ having a value of "1", whereby the specific sampling data $D_M$ read out from the wave memory 208 is stored in the first current sample memory 306 through the selector 304. Therefore, the so far obtained content $YS_{M-1}$ of the first current sample memory 306 is discarded, and the first current sample memory 306 is initialized.

At a subsequent cycle, the decoding circuit 209A generates the sampling data $Yd_{M+1}$ on the basis of the content $YS_{n-1}$ (the specific sampling data $D_M$) of the first current sample memory 306 and the content $YS_{n-2}$ (the sampling data $Yd_{M-1}$) of the second current sample memory 309 at that point of time. At a cycle subsequent thereto, the decoding circuit 209A generates the sampling data $Yd_{M+2}$ on the basis of the content $YS_{n-1}$ (the sampling data $Yd_{M+1}$) of the first current sample memory 306 and the content $YS_{n-2}$ (the specific sampling data $Yd_M$) of the second current sample memory 309 at that point of time. Thereafter, the decoding circuit 209A consecutively generates the sampling data on the basis of the content $YS_{n-1}$ of the first current sample memory 306, the content of $YS_{n-2}$ of the second current sample memory 309 and the differential wave data.

When the tone generation circuit of Example 2 shown in FIG. 7 is used, and if a plurality of the specific sampling data $D_{M1}, D_{M2}, \ldots$ of PCM format are stored in the wave memory 208, the first current sample memory 306 or the second current sample memory 309 can be initialized with a plurality of the specific sampling data $D_{M1}, D_{M2}, \ldots$. In this case, it is not required to store the specific sampling data $D_{M1}, D_{M2}\ldots$ in continuous memory positions in the wave memory 208.

In Example 6, the first current sample memory 306 is initialized with the specific sampling data $D_M$ when the wave readout address $A_M$ is generated. Further, the second current sample memory 309 is initialized with the specific sampling data $D_M$ when the wave readout address $A_{M+1}$ is generated, so that error accumulation caused by generating the sampling data $Yd_n$ on the basis of Equation (3) can be decreased. Such error occurs when the differential wave data $\Delta Wd_n$ is prepared on the basis of Equation (2).

EXAMPLE 7

In Example 7, the specific sampling data is composed of the specific sampling data $D_m$ (wherein m=M, M+1, . . . M+q−1 and q is a degree) in a quantity of q. That is, a musical tone signal is generated on the basis of a plurality of the differential wave data $\Delta Wd_n$ prepared by the linear prediction method and a plurality (q pieces) of the specific sampling data $D_m$. These differential wave data $\Delta Wd_n$ and specific sampling data $D_m$ are read out from the wave storage means once in an ascending order.

The specific sampling data $D_m$ (wherein m=M, M+1, . . . M+q−1) in Example 7 are selected among the sampling data $D_i$ (i=0, 1, 2, . . . N−1). In Example 7, a quadratic linear prediction method is used. As the specific sampling data $D_m$, therefore, the sampling data $D_M$ and $D_{M+1}$ are used. The sampling data $D_M$ and $D_{M+1}$ are respectively designated by the wave readout address $A_M$ and $A_{M+1}$. The differential wave data $\Delta Wd_n$ is prepared in the same manner as in Example 6. These specific sampling data $D_m$ and differential wave data $\Delta Wd_n$ are stored in the wave memory 208. The wave memory 208 corresponds to the wave storage means.

In Example 7, the decoding circuit 209A shown in FIG. 11 can be used as it is. The decoding circuit 209A corresponds to the decoding means and the temporary storage means. In Example 7, further, as a tone generation circuit, the tone generation circuit of Example 2 shown in FIG. 7 can be used as it is. In this case, the loop top address memory 211 stores the loop top address LT corresponding to the wave readout address $A_M$, and the initializing address memory 215 stores the initializing address IA corresponding to the wave readout address $A_{M+1}$. The address generating means in Example 7 is the same as that in Example 2. According to the instruction from the CPU, the address generating means generates the wave readout address $A_0, A_1, \ldots, A_{M-1}, A_M, A_{M+1}, \ldots, A_{N-1}$ in the same operation as that in Example 2.

The operation of the signal generating apparatus in Example 7 will be explained with reference to FIGS. 7 and 11 hereinafter. As explained in Example 6, the tone generation circuit initializes the first current sample memory 306 and the second current sample memory 309, and then, initiates the generation of the sampling data $Yd_n$.

When the address generating means generates the wave readout address $A_M$, the comparator 212 outputs "1", and the OR gate 217 outputs the control signal $\alpha$ having a value of "1", whereby the content $YS_{n-1}$ of the first current sample memory 306 is moved to the second current sample memory 309, and then, the specific sampling data $D_M$ from the wave memory 208 is stored in the first current sample memory 306 through the selector 304.

At a subsequent cycle, the address generating means generates the wave readout address $A_{M+1}$. Therefore, the comparator 216 outputs "1", and the OR gate 217 outputs the control signal $\alpha$ having a value of "1", whereby the content $YS_{n-1}$ (the specific sampling data $D_M$) of the first current sample memory 306 is moved to the second current sample memory 309. Then, the specific sampling data $D_{M+1}$ from the wave memory 208 is stored in the first current sample memory 306 through the selector 304. By the above two-cycle operation, the first current sample memory 306 and the second current sample memory 309 are initialized. Thereafter, the decoding circuit 209A generates the sampling data according to the Equation (3') with the content $YS_{n-1}$ (the specific sampling data $D_{M+1}$) of the first current sample memory 306 and the content of $YS_{n-2}$ (the specific sampling data $D_M$) of the second current sample memory 309 as initial values.

Example 7 explains an embodiment using a quadratic linear prediction method. When a linear prediction method of q degrees is used, there can be employed a constitution in which the number of the specific sampling data $D_m$ is q pieces, (q−1) sets, each set consisting of an initializing address memory and a comparator, are provided, and the output from each comparator is supplied to the OR gate 217.

Further, the constitution in Example 7 is that, by providing the initializing address memory 215, the comparator 216 and the OR gate 217, the control signal $\alpha$ is "1" while the wave readout addresses $A_M$ and $A_{M+1}$ are generated, while there may be employed a constitution in which, for example, a latch is provided between the output terminal of the comparator 212 and the decoding circuit 209A and the output from the comparator 212 is held at "1" with the latch during 2 cycles.

In Example 7, when the wave readout address $A_{M+2}$ is generated, the first current sample memory 306 and the second current sample memory 309 are initialized with two specific sampling data $D_{M+1}$ and $D_M$. Therefore, error accumulation can be suppressed.

EXAMPLE 8

In Example 8, the address generating means generates the wave readout address $A_0, A_1, \ldots, A_{M-1}, A_M, A_{M+1}, \ldots, A_{N-1}$, and then, consecutively generates the wave readout address $A_m$ (wherein m=M, M+1, . . . M+q−1) and the wave readout address $A_m$ (wherein n=M+q, M+q+1, . . . N−1) in an ascending order. That is, in Example 8, a musical tone signal is generated on the basis of a plurality of the differential wave data $\Delta Wd_n$ prepared by a linear prediction method and q pieces (2 pieces in Example 8) of the specific sampling data $D_m$. These specific sampling data $D_m$ (wherein m=M, M+1, . . . M+q−1) and the differential wave data $\Delta Wd_n$ (wherein n=M+q, M+q+1, . . . N−1) are repeatedly read out from the wave storage means in an ascending order.

Example 8 uses a quadratic linear prediction method. Therefore, the specific sampling data $D_m$ and the differential wave data $\Delta Wd_n$ are prepared in the same manner as in Example 7 and stored in the wave memory 208.

Figure 13:
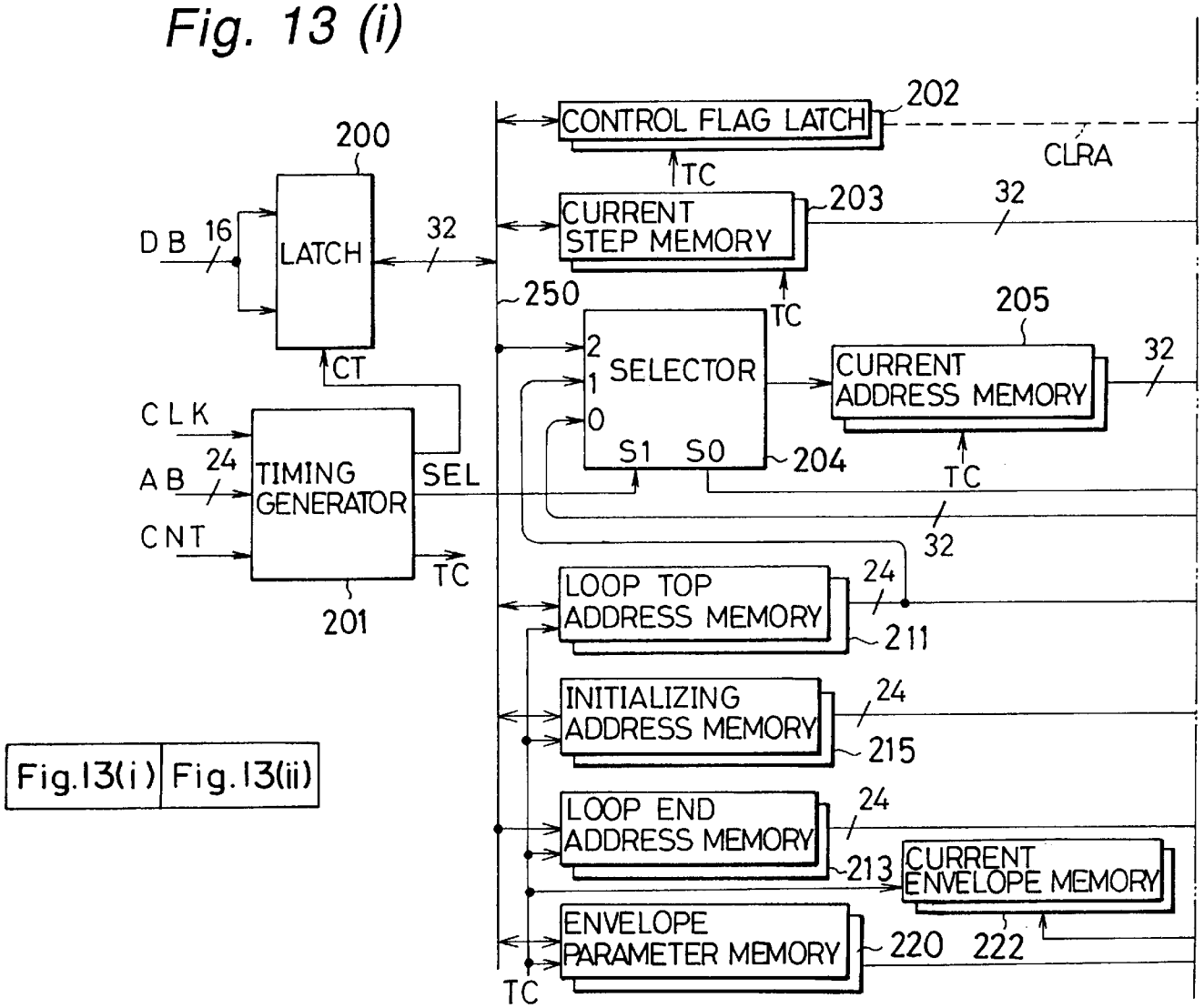
FIGS. 13(*i*) and 13(*ii*) are block diagrams of a tone generation circuit in Example 8.

FIG. 13 is a block diagram of a tone generation circuit in Example 8. In the tone generation circuit, the decoding circuit 209A shown in FIG. 11 can be used as it is. The constitution and the operation of the tone generation circuit in Example 8 will be explained in detail with reference to the block diagram shown in FIG. 13 hereinafter.

The tone generation circuit in Example 8 has a constitution in which the initializing address memory 215, the comparator 216 and the OR gate 217 are further added to the tone generation circuit of Example 3 shown in FIG. 8. Those portions and elements which are the same as, or correspond to, those in FIG. 8 are shown by the same reference numerals. Explanations thereof are omitted or simplified, and the additional portions will be mainly explained below.

In Example 8, like Example 7, the loop top address memory 211 stores the loop top address LT corresponding to the wave readout address $A_M$, and the initializing address memory 215 stores the initializing address IA corresponding to the wave readout address $A_{M+1}$.

The operation of the tone generation circuit in Example 8 will be explained with reference to FIG. 13 hereinafter. The address generating means in Example 8 has the same constitution as that of the address generating means in Example 3.

In Example 8, like Example 7, the sampling data $Yd_n$ and the specific sampling data $D_m$ of the attack portion and the repeat portion are first generated once. And, like Example 3, the address generating means generates the wave readout address $A_{N-1}$, and then, generates the wave readout address $A_M$, whereby the generation of the sampling data $Yd_n$ and the specific sampling data $D_m$ of the repeat portion of the wave data group are repeated. The operation when the address generating means generates the wave readout address $A_M$ and $A_{M+1}$ are the same as that in Example 7.

In Example 8, each time when the wave readout address $A_M$ corresponding to loop top address LT is generated, the linear prediction is resumed at an initial value. As a result, error accumulation which is caused by repeated readout and inherent to the DPCM method or the ADPCM method can be suppressed.

EXAMPLE 9

In Example 9, the address generating means generates the wave readout address $A_0, A_1, \ldots, A_{M-1}, A_M, A_{M+1}, \ldots, A_{N-1}$, and then, consecutively generates the wave readout address $A_n$ [wherein n=R, R+1, . . . M−1, M+q, M+q+1, . . . N−1 and R is determined so as to satisfy that the sampling data $D_{R-k}$ equals the sampling data $D_{N-k}$ (wherein k=1, 2, . . . q)] and the wave readout address $A_m$ (wherein m=M, M+1, . . . M+q−1) in an ascending order. That is, in Example 9, a musical tone signal is generated on the basis of a plurality of the differential wave data $\Delta Wd_n$ prepared by a linear prediction method and q pieces (2 pieces in Example 9) of the specific sampling data $D_m$. Unlike Example 8, however, the specific sampling data $D_m$ is stored in a position other than a position designated by the loop top address LT in the wave memory 208. The differential wave data $\Delta Wd_n$ (wherein n=R, R+1, . . . M−1, M+q, M+q+1, . . . N−1) and the specific sampling data $D_m$ (wherein m=M, M+1, . . . M+q−1) are repeatedly read out from the wave storage means in an ascending order.

Example 9 uses a quadratic linear prediction method. The differential wave data $\Delta Wd_n$ are prepared in the same manner as in Example 8. The specific sampling data $D_M$ and $D_{M+1}$ are selected among the sampling data $D_i$ which are within the repeat portion and are not included in the top and end of the repeat portion. That is, "M" satisfies the relationship of R<M<N−2. The differential wave data $\Delta Wd_n$ and the specific sampling data $D_M$, $D_{M+1}$ are stored in the wave memory 208.

In Example 9, the loop top address LT corresponds to the wave readout address $A_R$ wherein R is determined so as to satisfy that the sampling data $D_{R-1}$ equals the sampling data $D_{N-1}$ and that the sampling data $D_{R-2}$ equals sampling data $D_{N-2}$. In a position designated by the loop top address LT in the wave memory 208, the differential wave data $\Delta Wd_R$ is stored.

Figures 14, 14I:
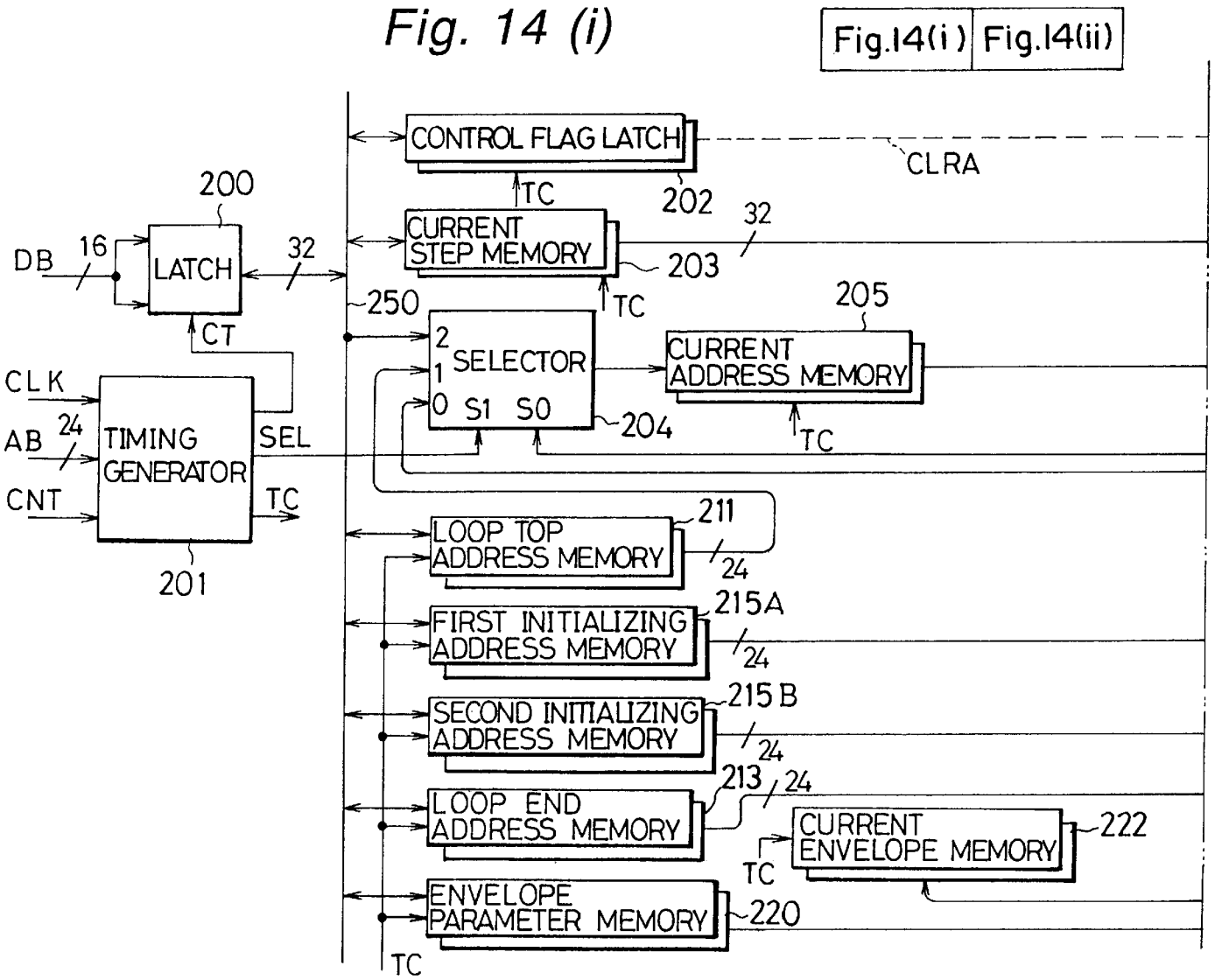
FIGS. 14(*i*) and 14(*ii*) are block diagrams of a tone generation circuit in Example 9.

FIG. 14 is a block diagram of the tone generation circuit in Example 9. In the tone generation circuit, the decoding circuit 209A shown in FIG. 11 can be used as it is. The decoding circuit 209A corresponds to the decoding means and the temporary storage means. The constitution and the operation of the tone generation circuit in Example 9 will be explained in detail with reference to the block diagram shown in FIG. 14 hereinafter.

The tone generation circuit in Example 9 has the same constitution as that of tone generation circuit of Example 5 shown in FIG. 10 except that the initializing address memory is replaced with first and second initializing address memories 215A and 215B, that the comparator 216 is replaced with comparators 216A and 216B and further that the OR gate 217 is added. Those portions and elements which are the same as, or correspond to, those in FIG. 10 are shown by the same reference numerals. Explanations thereof are omitted or simplified, and the additional portions will be mainly explained hereinafter.

In Example 9, the loop top address memory 211 stores the loop top address LT corresponding to the wave readout address $A_R$. The first initializing address memory 215A stores the initializing address IA-1 corresponding to the wave readout address $A_M$, and the second initializing address memory 215B stores initializing address IA-2 corresponding to the wave readout address $A_{M+1}$.

The operation of the tone generation circuit in Example 9 will be explained with reference to FIG. 14 hereinafter. The address generating means in Example 9 has the same constitution as that in Example 5. The address generating means generates the wave readout address $A_0$, $A_1$, . . . , $A_{M-1}$, $A_M$, $A_{M+1}$, . . . , $A_{N-1}$, and then, consecutively generates the wave readout address $A_n$ (n=R, R+1, . . . M−1, M+2, . . . N−1) and the wave readout address $A_M$, $A_{M+1}$ in an ascending order.

In Example 9, first, the address generating means generates the wave readout address $A_0$, $A_1$, . . . , $A_{M-1}$, $A_M$, $A_{M+1}$, . . . , $A_{N-1}$, whereby the sampling data $YD_n$ and the specific sampling data $D_M$ and $D_{M+1}$ of the attack portion and the repeat portion are generated. When the wave readout address $A_{N-1}$ is generated, the address generating means generates the wave readout address $A_R$ in the same operation as that in Example 5, whereby the generation of the sampling data $Yd_n$ and the specific sampling data $D_M$ and $D_{M+1}$ based on the wave data of the repeat portion of the wave data group are repeated. The operation when the address generating means generates the wave readout addresses $A_M$ and $A_{M+1}$ is the same as that in Example 7.

In Example 9, it is not necessary to store the specific sampling data $D_m$ in a position designated by the loop top address LT in the wave memory 208, and therefore the room for the selection of the specific sampling data $D_m$ can be broadened.

As explained above, according to the present invention, there is provided a signal generating apparatus which has a simple circuit constitution and can suppress error accumulation caused by repeatedly reading out the differential wave data of the repeat section when a signal is reproduced by a ADPCM method or a DPCM method, and which further can suppress error accumulation at a time when the differential wave data is not read out repeatedly, and a signal generating method therefor.

What is claimed is:

1. A signal generating apparatus comprising:

(A) wave storage means for storing specific sampling data $D_M$, wherein 0<M<N−1, selected among sampling data $D_i$ obtained by sampling a wave at sampling points $P_i$, wherein i=0, 1, 2, . . . N−1, and differential wave data $\Delta WD_n$, wherein n=1,2,3, . . . , M−1, M+1, . . . N−2, N−1, obtained by Equation (1), $$\Delta WD_n = D_n - D_{n-1} \quad \text{Equation (1)}$$

(B) address generating means for consecutively generating a wave readout address $A_M$ for designating the specific sampling data $D_M$ in the wave storage means and a wave readout address $A_n$ for designating the differential wave data $\Delta WD_n$ in the wave storage means, (C) temporary storage means, (D) decoding means for receiving the specific sampling data $D_M$ designated by the wave readout address $A_M$ from the wave storage means and storing the specific sampling data $D_M$ in the temporary storage means when the address generating means generates the wave readout address $A_M$, and for receiving the differential wave data $\Delta WD_n$ designated by the wave readout address $A_n$ from the wave storage means and accumulating the differential wave data $\Delta WD_n$ in the temporary storage means and thereby generating a sampling data $YD_n$ when the address generating means generates the wave readout address $A_n$, and (E) signal generating means for generating a signal on the basis of the obtained specific sampling data $D_M$ or the sampling data $YD_n$.

2. The signal generating apparatus according to claim 1, in which the address generating means is constituted so as to generate the wave readout address $A_0$, $A_1$, . . . , $A_{M-1}$, $A_M$, $A_{M+1}$, . . . , $A_{N-1}$, and then, to generate the wave readout address $A_M$ and the wave readout address $A_n$, wherein n=M+1, . . . N−1, in an ascending order.

3. The signal generating apparatus according to claim 1, in which the address generating means is constituted so as to generate the wave readout address $A_0$, $A_1$, . . . , $A_{M-1}$, $A_M$, $A_{M+1}$, . . . , $A_{N-1}$, and then, to generate the wave readout address $A_{ud}$, wherein ud=N−2, N−3, N−4, . . . M+1, in a descending order, the decoding means is constituted so as to receive the differential wave data $\Delta D_{ud+1}$ designated by the wave readout address $A_{ud+1}$ from the wave storage means and to degressively deduct the differential wave data $\Delta WD_{ud+1}$ in the temporary storage means, thereby to generate sampling data $YD_{ud}$, and further, the address generating means is constituted so as to consecutively generate the wave readout address $A_M$ and the wave readout address $A_n$, wherein n=M+1, M+2, . . . N−1, in an ascending order, after the address generating means generates the wave readout address $A_{M+1}$.

4. The signal generating apparatus according to claim 1, in which the address generating means is constituted so as to generate the wave readout address $A_0, A_1, \ldots, A_{M-1}, A_M, A_{M+1}, \ldots, A_{N-1}$, and then, to generate the wave readout address $A_n$, wherein n=R, R+1, . . . M−1, M+1, . . . N−1 and R is determined so as to satisfy that the sampling data $D_{R-1}$ equals the sampling data $D_{N-1}$, and the wave readout address $A_M$ in an ascending order.

5. A signal generating apparatus comprising;

(A) wave storage means for storing specific sampling data $D_M$, wherein 0<M<n−1, selected among sampling data $D_i$ obtained by sampling a wave at sampling points $P_i$, wherein i=0, 1, 2, . . . N−1, and differential wave data $\Delta Wd_n$, wherein n=1, 2, 3, . . . , M−1, M+1, . . . N−2, N−1, obtained by Equation (2)

$$\Delta Wd_n = D_n - \sum_{k=1}^{q} \gamma_k D_{n-k} \qquad \text{Equation (2)}$$

wherein $\gamma_k$ is a linear predictive coefficient and q is a degree, (B) address generating means for consecutively generating wave readout address $A_M$ for designating the specific sampling data $D_M$ in the wave storage means and wave readout address $A_n$ for designating the differential wave data $\Delta Wd_n$ in the wave storage means, (C) temporary storage means having memory areas $S_k$ in a quantity of q, wherein k=1, 2, . . . q, (D) decoding means for receiving the specific sampling data $D_M$ designated by the wave readout address $A_M$ from the wave storage means, then moving a content of the memory area $S_k$ of the temporary storage means to the memory area $S_{k+1}$, wherein k=1, 2, . . . q−1, and then, storing the specific sampling data $D_M$ in the memory area $S_1$ when the address generating means generates the wave readout address $A_M$, and for receiving the differential wave data $\Delta Wd_n$ designated by the wave readout address $A_n$ from the wave storage means to generate sampling data $Yd_n$ by Equation (3), then moving a content of the memory area $S_k$ of the temporary storage means to the memory area $S_{k+1}$, wherein k=1, 2, . . . q−1, and then, storing the sampling data $Yd_n$ in the memory area $S_1$ when the address generating means generates the wave readout address $A_n$, $$Yd_n = \Delta Wd_n + \sum_{k=1}^{q} \gamma_k YS_{n-k} \qquad \text{Equation (3)}$$

wherein $YS_{n-k}$ is a content of the memory area $S_k$ of the temporary storage means in which k=1, 2, . . . q, and (E) signal generating means for generating a signal on the basis of the obtained specific sampling data $D_M$ or sampling data $Yd_n$.

6. A signal generating apparatus according to claim 5, in which the specific sampling data consists of specific sampling data $D_m$ in a quantity of q, wherein m=M, M+1, . . . M+q−1 and q is a degree.

7. A signal generating apparatus according to claim 6, in which the address generating means is constituted so as to generate the wave readout address $A_0, A_1, \ldots, A_{M-1}, A_M, A_{M+1}, \ldots, A_{N-1}$, and then, to generate the wave readout address $A_m$, wherein m=M, M+1, . . . M+q−1, and the wave readout address $A_n$, wherein n=M+q, M+q+1, . . . N−1, in an ascending order.

8. A signal generating apparatus according to claim 6, in which the address generating means is constituted so as to generate the wave readout address $A_0, A_1, \ldots, A_{M-1}, A_M, A_{M+1}, \ldots, A_{N-1}$, and then, to generate wave readout address $A_n$, wherein n=R, R+1, . . . M−1, M+q, M+q+1, . . . N−1 and R is determined to satisfy that the sampling data $D_{R-k}$ equals the sampling data $D_{N-k}$ in which k=1, 2, . . . q, and the wave readout address $A_m$, wherein m=M, M+1, . . . M+q−1, in an ascending order.

9. A signal generating method of generating a signal on the basis of specific sampling data $D_M$, wherein 0<M<N−1, selected among sampling data $D_i$ obtained by sampling a wave in sampling points $P_i$, wherein i=0, 1, 2, . . . N−1, and differential wave data $\Delta WD_n$, wherein n=1, 2, 3, . . . , M−1, M+1, . . . N−2, N−1, obtained by Equation (4), $$\Delta WD_n = D_n = D_{n-1} \qquad \text{Equation (4)}$$

the method comprising;

(A) consecutively generating a wave readout address $A_M$ for designating the specific sampling data $D_M$ and a wave readout address $A_n$ for designating the differential wave data $\Delta WD_n$, (B) storing the specific sampling data $D_M$ designated by the wave readout address $A_M$ in memory area, when the generated wave readout address is $A_M$, or accumulating the differential wave data $\Delta WD_n$ designated by the wave readout address $A_n$ in the memory area, thereby to generate a sampling data $YD_n$, when the generated wave readout address is $A_n$, and (C) generating a signal on the basis of the obtained specific sampling data $D_M$ or the sampling data $YD_n$.

10. The signal generating method according to claim 9, in which the wave readout address $A_0, A_1, \ldots, A_{M-1}, A_M, A_{M+1}, \ldots, A_{N-1}$ are generated, and then, the wave readout address $A_M$ and $A_n$, wherein n=M+1, . . . N−1, are generated in an ascending order.

11. The signal generating method according to claim 10, in which the wave readout address $A_0, A_1, \ldots, A_{M-1}, A_M, A_{M+1}, \ldots, A_{N-1}$ are generated, then, the wave readout address $A_{ud}$, wherein ud=N−2, N−3, N−4, . . . M+1, are consecutively generated in a descending order, and differential wave data $\Delta WD_{ud+1}$ designated by the wave readout address $A_{ud+1}$ is degressively deducted in the memory area, thereby to generate the sampling data $YD_{ud}$, and after the wave readout address $A_{M+1}$ is generated, the wave readout address $A_M$ and wave readout address $A_n$, wherein n=M+1, M+1, . . . N−1, are consecutively generated in an ascending order.

12. The signal generating method according to claim 10, in which the wave readout address $A_0, A_1, \ldots, A_{M-1}, A_M, A_{M+1}, \ldots, A_{N-1}$ are generated, and then, the wave readout address $A_n$, wherein n=R, R+1, . . . M−1, M+1, . . . N−1 and R is determined so as to satisfy that the sampling data $D_{R-1}$ equals the sampling data $D_{N-1}$, and the wave readout address $A_M$ in an ascending order.

13. A signal generating method of generating a signal on the basis of specific sampling data $D_M$, wherein 0<M<N−1, selected among sampling data $D_i$ obtained by sampling a wave in sampling points $P_i$, wherein i=0, 1, 2, . . . N−1, and differential wave data $\Delta Wd_n$, wherein n=1, 2, 3, . . . , M−1, M+1, . . . N−2, N−1, obtained by Equation (5), $$\Delta Wd_n = D_n - \sum_{k=1}^{q} \gamma_k D_{n-k} \quad \text{Equation (5)}$$

wherein $\gamma_k$ is a linear predictive coefficient and q is a degree, the method comprising;

(A) consecutively generating wave readout address $A_M$ for designating the specific sampling data $D_M$ and wave readout address $A_n$ for designating the differential wave data $\Delta WD_n$, (B) moving a content of memory area $S_k$, wherein k=1, 2, . . . q−1, to the memory area $S_{k+1}$, and then, storing the specific sampling data $D_M$ designated by the wave readout address $A_M$ in the memory area $S_1$, when the generated wave readout address is $A_M$, or generating sampling data $Yd_n$ by Equation (6), then moving a content of the memory area $S_k$, wherein k=1, 2, . . . q−1, to the memory area $S_{k+1}$ and storing the sampling data $Yd_n$ in the memory area $S_1$, $$Yd_n = \Delta Wd_n + \sum_{k=1}^{q} \gamma_k YS_{n-k} \quad \text{Equation (6)}$$

wherein $\Delta Wd_n$ is the differential wave data designated by the wave readout address $A_n$ and $YS_{n-k}$ is a content of the memory area $S_k$, wherein k=1, 2, . . . q, and (C) generating a signal on the basis of the obtained specific sampling data $D_M$ or sampling data $Yd_n$.

14. The signal generating method according to claim 13, in which the specific sampling data consists of specific sampling data $D_m$ in a quantity of q, wherein m=M, M+1, . . . M+q−1 and q is a degree.

15. The signal generating method according to claim 14, in which the wave readout address $A_0, A_1, \ldots, A_{M-1}, A_M, A_{M+1}, \ldots, A_{N-1}$ are generated, and then, the wave readout address $A_m$, wherein m=M, M+1, . . . M+q−1, and the wave readout address $A_n$, wherein n=M+q, M+q+1, . . . N−1, are consecutively generated in an ascending order.

16. The signal generating method according to claim 14, in which the wave readout address $A_0, A_1, \ldots, A_{M-1}, A_M, A_{M+1}, \ldots, A_{N-1}$ are generated, and then, the wave readout address $A_n$, wherein n=R, R+1, . . . M−1, M+q, M+q+1, . . . N−1 and R is determined so as to satisfy that the sampling data $D_{R-k}$ equals the sampling data $D_{N-k}$ in which k=1, 2, . . . q, and the wave readout address $A_m$, wherein m=M, M+1, . . . M+q−1, are consecutively generated in an ascending order.

* * * * *